US007873298B2

(12) United States Patent
Yamashita et al.

(10) Patent No.: US 7,873,298 B2
(45) Date of Patent: Jan. 18, 2011

(54) CLEANING DEVICE, PROCESS CARTRIDGE, AND IMAGE FORMING APPARATUS

(75) Inventors: Yasuyuki Yamashita, Zama (JP); Hidetoshi Yano, Yokohama (JP); Oasamu Naruse, Yokohama (JP); Naomi Sugimoto, Kiwasaki (JP); Kenji Sugiura, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 408 days.

(21) Appl. No.: 12/007,391

(22) Filed: Jan. 10, 2008

(65) Prior Publication Data

US 2008/0170878 A1 Jul. 17, 2008

(30) Foreign Application Priority Data

Jan. 10, 2007 (JP) ..... 2007-002422

(51) Int. Cl.
*G03G 21/00* (2006.01)
*G03G 21/10* (2006.01)

(52) U.S. Cl. ..... 399/99; 399/100; 399/129; 399/343; 399/350; 399/354

(58) Field of Classification Search ..... 399/100, 399/99, 123, 129, 101, 343, 349, 350, 353, 399/354, 357, 358
See application file for complete search history.

(56) References Cited

U.S. PATENT DOCUMENTS 3,884,572 A * 5/1975 Bacon et al. ..... 399/129
5,379,100 A * 1/1995 Kudo et al. ..... 399/351
5,606,408 A 2/1997 Yano et al.
5,619,316 A 4/1997 Shoji et al.
5,630,197 A * 5/1997 Nishino et al. ..... 399/117
5,740,494 A 4/1998 Shoji et al.
5,765,087 A 6/1998 Yano et al.
5,999,773 A 12/1999 Yasutomi et al.
6,033,827 A 3/2000 Itani
6,591,072 B2 * 7/2003 Hashimoto et al. ..... 399/50
6,799,012 B2 9/2004 Shakuto et al.
6,987,944 B2 1/2006 Shakuto et al.
7,062,212 B2 6/2006 Naruse et al.
7,103,301 B2 9/2006 Watanabe et al.
7,123,872 B2 10/2006 Shakuto et al.
7,184,699 B2 2/2007 Naruse et al.
7,209,699 B2 4/2007 Yamaguchi et al.
2002/0181983 A1 12/2002 Shakuto et al.
2003/0039494 A1 2/2003 Shakuto et al.
2004/0105710 A1 6/2004 Shakuto et al.

(Continued)

FOREIGN PATENT DOCUMENTS

JP 63-219624 9/1988

(Continued)

*Primary Examiner*—Constantine Hannaher
(74) *Attorney, Agent, or Firm*—Harness, Dickey & Pierce, P.L.C.

(57) ABSTRACT

A cleaning device including a polarity control unit to control a charge polarity of residual toner particles, a cleaning member, a surface of which is movable, to electrostatically remove the residual toner particles, provided on a downstream side from the polarity control unit relative to a surface moving direction of an image bearing member, a toner collecting unit to collect the residual toner particles on the cleaning member, and a neutralizing member to neutralize the image bearing member, provided on a downstream side from the polarity control unit and an upstream side from the cleaning member relative to the surface moving direction of the image bearing member.

13 Claims, 21 Drawing Sheets

U.S. PATENT DOCUMENTS

| | | | | |
|---|---|---|---|---|
| 2004/0197122 | A1 | 10/2004 | Nakano et al. | |
| 2004/0265024 | A1 | 12/2004 | Naruse et al. | |
| 2005/0058474 | A1 | 3/2005 | Watanabe et al. | |
| 2005/0100375 | A1 | 5/2005 | Naruse et al. | |
| 2005/0191099 | A1 | 9/2005 | Yamaguchi et al. | |
| 2005/0254868 | A1 | 11/2005 | Naruse et al. | |
| 2006/0013615 | A1* | 1/2006 | Nukada et al. | 399/159 |
| 2006/0099016 | A1 | 5/2006 | Watanabe et al. | |
| 2006/0133872 | A1 | 6/2006 | Sugiura et al. | |
| 2006/0285897 | A1 | 12/2006 | Sugiura et al. | |
| 2006/0285898 | A1 | 12/2006 | Watanabe et al. | |
| 2007/0003337 | A1 | 1/2007 | Shakuto et al. | |
| 2007/0166087 | A1 | 7/2007 | Yamaguchi et al. | |
| 2010/0003052 | A1* | 1/2010 | Nakamatsu et al. | 399/123 |

FOREIGN PATENT DOCUMENTS

| | | |
|---|---|---|
| JP | 64-068783 | 3/1989 |
| JP | 01-183520 | 7/1989 |
| JP | 01-213411 | 8/1989 |
| JP | 01-292116 | 11/1989 |
| JP | 05-158326 | 6/1993 |
| JP | 06-274074 | 9/1994 |
| JP | 10-131035 | 5/1998 |
| JP | 10-310974 | 11/1998 |
| JP | 2002-268494 | 9/2002 |
| JP | 2004-212823 | 7/2004 |
| JP | 2005-265905 | 9/2005 |
| JP | 2005-265907 | 9/2005 |

* cited by examiner

CLEANING DEVICE, PROCESS CARTRIDGE, AND IMAGE FORMING APPARATUS

PRIORITY STATEMENT

The present patent application claims priority from Japanese Patent Application No. 2007-002422 filed on Jan. 10, 2007 in the Japan Patent Office, the entire contents of which are hereby incorporated herein by reference.

BACKGROUND

1. Field

Example embodiments generally relate to an image forming apparatus, such as a copying machine, a facsimile machine, and a printer, a process cartridge employed in the image forming apparatus and a cleaning device employed in the image forming apparatus or the process cartridge.

2. Description of the Related Art

A related-art image forming apparatus, such as a copying machine, a facsimile machine, a printer, or a multifunction printer having two or more of copying, printing, scanning, and facsimile functions, forms a toner image on a recording medium (e.g., a sheet) according to image data using an electrophotographic method. In such a method, for example, a charger charges a surface of an image bearing member (e.g., a photoconductor). An optical device emits a light beam onto the charged surface of the photoconductor to form an electrostatic latent image on the photoconductor according to the image data. The electrostatic latent image is developed with a developer (e.g., a toner) to form a toner image on the photoconductor. A transfer device transfers the toner image formed on the photoconductor onto a sheet. A fixing device applies heat and pressure to the sheet bearing the toner image to fix the toner image onto the sheet. The sheet bearing the fixed toner image is then discharged from the image forming apparatus.

The related-art image forming apparatus further includes a cleaning device including a cleaning blade. The cleaning blade includes an elastic member, and contacts the surface of the image bearing member to remove residual toner particles from the surface of the image bearing member. Such a cleaning method is known as a blade cleaning method, and is widely used by virtue of providing stable cleaning performance with a simple configuration.

To meet a demand for higher quality images, toner particles having a smaller particle diameter and a spherical shape are developed in recent years. The toner particles having a smaller particle diameter provide images with higher accuracy, definition, and resolution. The toner particles having a spherical shape improve development and transfer performance.

However, it is difficult to remove the toner particles having a smaller particle diameter and a spherical shape from the surface of the image bearing member by using the blade cleaning method due to a tiny space formed between the image bearing member and the cleaning blade. When the cleaning blade contacts the surface of the image bearing member to remove the toner particles from the surface of the image bearing member, an edge portion of the cleaning blade may be deformed due to friction resistance with the surface of the image bearing member. As a result, a stick-slip motion occurs, causing the tiny space between the image bearing member and the cleaning blade. The smaller the toner particles are, the easier the toner particles are to enter the tiny space. Moreover, the rounder the toner particles entering the tiny space are, the easier the toner particles are to roll in the tiny space due to rotational moment. As a result, the cleaning blade is pushed up by the toner particles, so that the toner particles easily enter the tiny space between the image bearing member and the cleaning blade. Therefore, the cleaning blade cannot remove the toner particles from the surface of the image bearing member.

One possible technique of preventing the toner particles from entering the tiny space is to increase linear pressure of the cleaning blade against the image bearing member. However, high linear pressure causes high loads on the image bearing member and the cleaning blade. As a result, the image bearing member and the cleaning blade are worn away, shortening a product life.

One example of a cleaning device uses an electrostatic cleaning method in order to remove the toner particles having a smaller particle diameter and a spherical shape from the surface of the image bearing member. A voltage with the polarity opposite to that of the toner particles is applied to an electrostatic cleaning member such as a conductive cleaning brush in contact with the surface of the image bearing member, so that the toner particles are electrostatically removed from the surface of the image bearing member. However, the toner particles may not be removed from the surface of the image bearing member even by using the electrostatical cleaning method due to a variation in charge amount of the toner particles conveyed to the cleaning device. For example, FIG. 3 is a graph illustrating charge distributions of the toner particles on the surface of the image bearing member before and after transfer is performed at normal temperature and humidity. As shown in FIG. 3, most of the toner particles on the image bearing member before transfer is performed are charged to the negative polarity, which is a regular polarity of the toner particles. In the transfer device, a transfer bias with the polarity opposite to that of the toner particles, namely, the positive transfer bias, is applied to the toner particles on the surface of the image bearing member, so that the toner particles thereon are transferred onto a transfer sheet. However, because the polarity of a part of the toner particles on the surface of the image bearing member may be reversed to positive due to the positive charge injected from the transfer device, such toner particles may remain on the surface of the image bearing member after transfer has been performed, resulting in residual toner particles. Therefore, the residual toner particles on the image bearing member after transfer has been performed has a broader charge distribution including both the positively charged toner particles and the negatively charged toner particles as shown in FIG. 3. In the electrostatic cleaning method described above, a positive voltage, which is opposite to the polarity of the toner particles, is applied to the cleaning brush to electrostatically remove the toner particles from the surface of the image bearing member. Therefore, it is difficult to remove the toner particles with the polarity reversed to positive by using the positively charged cleaning brush.

Another example of a cleaning device is proposed in which a polarity control unit to control the polarity of the residual toner particles is provided on an upstream side of the electrostatic cleaning member. The polarity control unit controls the residual toner particles on the surface of the image bearing member to have the negative polarity, which is a regular polarity of the toner particles, so that the positively charged cleaning brush provided on a downstream side of the polarity control unit can easily collect the toner particles.

Such a polarity control units uses a micro discharge of a corona charger provided apart from the surface of the image bearing member, and a charge injection from an energized conductive brush roller in contact with the surface of the image bearing member. A compact polarity control unit with a simple configuration, which uses a charge injection from an energized conductive blade, is also proposed.

However, the polarity control units described above simultaneously charge the image bearing member bearing the residual toner particles thereon when controlling the polarity of the residual toner particles. Consequently, the surface of the image bearing member which is charged to a highly negative potential is conveyed to the cleaning brush to which the positive voltage is applied. Because the cleaning brush includes a brush string including a conductive material, a positive charge may be injected into the residual toner particles between the surface of the image bearing member and the cleaning brush. Particularly, when a potential gradient between the surface of the image bearing member and the cleaning brush is large, a larger amount of current flows into the residual toner particles between the surface of the image bearing member and the cleaning brush in order to compensate the potential gradient, and the positive charge is injected into the residual toner particles. Thus, the polarity of the residual toner particles is reversed to positive, so that the cleaning brush may not collect the residual toner particles with the positive polarity. As a result, a larger number of cleaning residual toner particles with the positive polarity remains on the surface of the image bearing member.

SUMMARY

In order to reduce the number of the cleaning residual toner particles, it is required to reduce the charge injection into the residual toner particles from the cleaning brush.

Example embodiments provide an image forming apparatus including a cleaning device to electrostatically remove residual toner particles on an image bearing member by using a cleaning member to which a voltage with a polarity opposite to that of the residual toner particles is applied, and a process cartridge which may achieve improved cleaning performance.

At least one embodiment provides a cleaning device including a polarity control unit to control a charge polarity of residual toner particles, a cleaning member, a surface of which is movable, to electrostatically remove the residual toner particles, provided on a downstream side from the polarity control unit relative to a surface moving direction of an image bearing member, a toner collecting unit to collect the residual toner particles on the cleaning member, and a neutralizing member to neutralize the image bearing member, provided on a downstream side from the polarity control unit and an upstream side from the cleaning member relative to the surface moving direction of the image bearing member.

At least one embodiment provides an image forming apparatus including an image bearing member to bear an electrostatic latent image, a charging device to charge a surface of the image bearing member, an irradiating device to irradiate the charged surface of the image bearing member to form an electrostatic latent image thereon, a developing device to develop the electrostatic latent image with a toner to form a toner image, a transfer device to transfer the toner image onto a recording medium, and a cleaning device to remove residual toner particles on the image bearing member. The cleaning device includes a polarity control unit to control a charge polarity of the residual toner particles, a cleaning member, a surface of which is movable, to electrostatically remove the residual toner particles, provided on a downstream side from the polarity control unit relative to a surface moving direction of the image bearing member, a toner collecting unit to collect the residual toner particles on the cleaning member, and a neutralizing member to neutralize the image bearing member, provided on a downstream side from the polarity control unit and an upstream side from the cleaning member relative to the surface moving direction of the image bearing member.

At least one embodiment provides a process cartridge detachably attachable to an image forming apparatus including an image bearing member and a cleaning device. The cleaning device includes a polarity control unit to control a charge polarity of residual toner particles on the image bearing member, a cleaning member, a surface of which is movable, to electrostatically remove the residual toner particles, provided on a downstream side from the polarity control unit relative to a surface moving direction of the image bearing member, a toner collecting unit to collect the residual toner particles on the cleaning member, and a neutralizing member to neutralize the image bearing member, provided on a downstream side from the polarity control unit and an upstream side from the cleaning member relative to the surface moving direction of the image bearing member.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
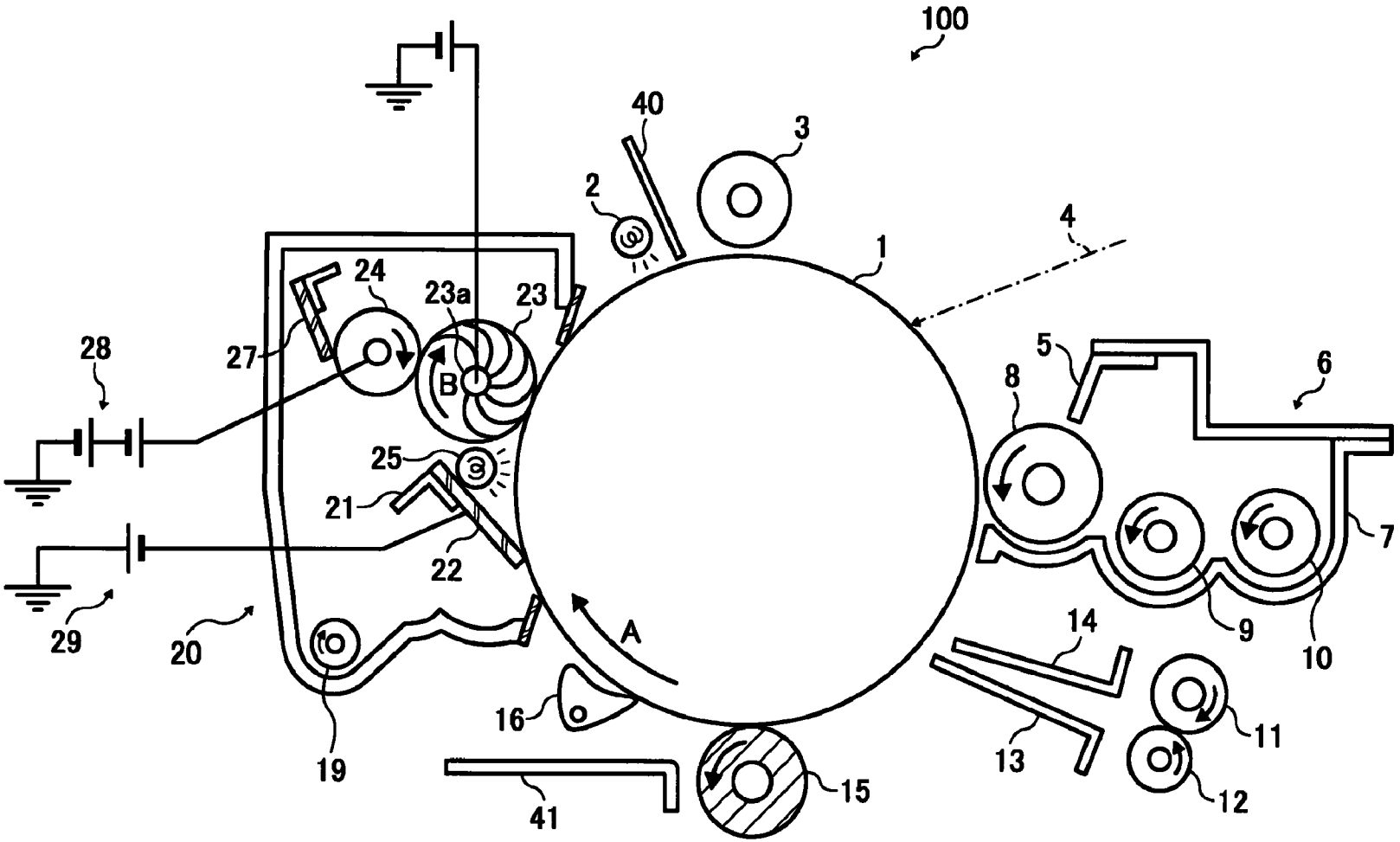
FIG. 1 is a schematic view illustrating main components of an image forming apparatus according to example embodiments.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of example embodiments.

The terminology used herein is for the purpose of describing example embodiments only and is not intended to be limiting. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner. Reference is now made to the drawings, wherein like reference numerals designate identical or corresponding parts throughout the several views.

Example embodiments applied to an electrophotographic printer serving as an image forming apparatus (hereinafter referred to as a "printer 100") are described in detail below.

FIG. 1 is a schematic view illustrating main components of the printer 100 according to example embodiments. The printer 100 forms monochrome images based on image data read by an image reading unit, not shown. Referring to FIG. 1, the printer 100 includes a drum-type photoconductor 1 serving as an image bearing member. A charging roller 3, a developing device 6 to develop a latent image into a toner image, a transfer roller 15 to transfer the toner image onto a transfer sheet, a cleaning device 20 to clean residual toner particles on a surface of the photoconductor 1 after the toner image has been transferred onto the transfer sheet, a neutralizing lamp 2 to neutralize the surface of the photoconductor 1, and so forth, are provided around the photoconductor 1. A shading plate 40 to shade a portion of the photoconductor 1 from light emitted from the neutralizing lamp 2 is provided between the neutralizing lamp 2 and the charging roller 3.

The charging roller 3 is provided apart from the photoconductor 1 by a predetermined or desired distance so as to charge the surface of the photoconductor 1 to a predetermined or desired polarity and a predetermined or desired potential level. For example, the charging roller 3 evenly charges the surface of the photoconductor 1 to the negative polarity in the printer 100. An exposure device, not shown, irradiates a laser beam 4 to the surface of the photoconductor 1 evenly charged by the charging roller 3 based on the image data read by the image reading unit, not shown. Accordingly, an electrostatic latent image is formed on the surface of the photoconductor 1.

The developing device 6 includes a developing roller 8 serving as a developer bearing member in which a magnet for generating a magnetic field is included. A power source, not shown, applies a developing bias to the developing roller 8. In a casing 7 of the developing device 6, a supply screw 9 and a stirring screw 10, both of which convey a two-component developer including a toner and a carrier stored in the casing 7 in a direction opposite to each other so as to stir the developer, are provided. The developing device 6 further includes a doctor blade 5 to control an amount of the developer carried by the developing roller 8. The toner included in the developer stirred and conveyed by the supply screw 9 and the stirring screw 10 is negatively charged. The developer is attracted to the developing roller 8 by an action of the magnet included in the developing roller 8. An amount of the developer attracted to the developing roller 8 is controlled by the doctor blade 5, and a magnetic force causes the developer to rise in a form of chain segments so as to form a magnetic brush in a developing area facing the photoconductor 1.

A power source, not shown, applies a transfer bias to the transfer roller 15.

A cleaning device 20 includes a cleaning brush 23 to be described in detail later, to electrostatically remove residual toner particles on the surface of the photoconductor 1.

Image forming operations performed by the printer 100 are described in detail below.

In the printer 100, when a start button provided in an operation unit, not shown, is pressed, the image reading unit, not shown, starts reading an original document. A predetermined or desired voltage or current is sequentially applied to the charging roller 3, the developing roller 8, the transfer roller 15, and the cleaning brush 23, respectively, at a predetermined or desired timing. At the same time, the photoconductor 1 is rotated in a direction indicated by an arrow A in FIG. 1 by a photoconductor driving motor, not shown, serving as a driving unit. When the photoconductor 1 is rotated, the developing roller 8, the transfer roller 15, the supply screw 9, the stirring screw 10, a toner discharging screw 19 to be described in detail later, the cleaning brush 23, and a collecting roller 24 are also rotated in a predetermined or desired direction, respectively.

When being rotated in a direction indicated by the arrow A in FIG. 1, the surface of the photoconductor 1 is charged to, for example, an electric potential of −700 V, by the charging roller 3. The exposure device, not shown, irradiates the laser beam 4 corresponding to an image signal to the surface of the photoconductor 1. The electric potential at a portion of the photoconductor 1 irradiated by the laser beam 4 falls to, for example, −120 V, so that an electrostatic latent image is formed on the surface of the photoconductor 1. The surface of the photoconductor 1 having the electrostatic latent image thereon contacts the magnetic brush formed of the developer on the developing roller 8 at the portion facing the developing device 6. At this time, the negatively charged toner particles on the developing roller 8 are attracted to the electrostatic latent image by a developing bias of, for example, −450 V, applied to the developing roller 8, consequently, a toner image is formed on the surface of the photoconductor 1. As described above, in example embodiments, the electrostatic latent image formed on the surface of the photoconductor 1 is developed with the toner negatively charged by the developing device 6 by using a reversal developing process, also known as a negative-positive developing process, in which the toner is adhered to a portion of the electrostatic latent image having a lower electric potential.

The transfer sheet supplied from a paper feed unit, not shown, is conveyed through a portion between an upper registration roller 11 and a lower registration roller 12 in synchronization with a leading edge of the toner image formed on the surface of the photoconductor 1. Subsequently, the transfer sheet is guided by guide plates 13 and 14. When the transfer sheet is conveyed through a transfer area formed between the photoconductor 1 and the transfer roller 15, the toner image formed on the surface of the photoconductor 1 is transferred onto the transfer sheet. When the toner image is transferred onto the transfer sheet, a transfer bias of, for example, +10 μA under a constant current control, is applied to the transfer roller 15. The transfer sheet having the transferred toner image thereon is detached from the photoconductor 1 by a separation pick 16, and is guided by a conveyance guide plate 41 to a fixing device, not shown. When the transfer sheet passes through the fixing device, heat and pressure are applied to the transfer sheet so that the toner image is fixed thereto. Thereafter, the transfer sheet is discharged from the printer 100.

Meanwhile, after the toner image formed on the surface of the photoconductor 1 has been transferred to the transfer sheet, residual toner particles on the surface of the photoconductor 1 are removed by the cleaning device 20. Thereafter, the surface of the photoconductor 1 is neutralized by the neutralizing lamp 2.

Prior to describing the cleaning device 20 to remove the residual toner particles on the surface of the photoconductor 1, a related-art cleaning device using a blade cleaning method is described in detail below.

An image forming apparatus is required to provide high resolution performance in order to form images with higher accuracy and definition. Toner particles having a smaller particle diameter are used to meet the above-described requirement. In addition, toner particles having a spherical shape are widely used rather than those having an irregular shape in order to improve transfer performance. However, the related-art cleaning device using the blade cleaning method has trouble removing such toner particles from the surface of the photoconductor.

If the cleaning blade presses the photoconductor with high liner pressure, for example, a linear pressure of not less than 100 gf/cm, the toner particles having a smaller particle diameter and a spherical shape can be removed from the surface of the photoconductor. However, such a high linear pressure shortens a product life of the photoconductor and the cleaning blade. When the cleaning blade presses the photoconductor with a normal linear pressure of 20 gf/cm, the photoconductor with a diameter of 30 mm has a life of about 100,000 copies, resulting in abrasion of a photosensitive layer such that the thickness thereof is reduced to one-third, and the cleaning blade has a life, for collecting residual toner particles on the surface of the photoconductor, of about 120,000 copies. On the other hand, when the cleaning blade presses the photoconductor with a high linear pressure of 100 gf/cm, the photoconductor with a diameter of 30 mm has a life of about 20,000 copies, and the cleaning blade has a life of about 200,000 copies. Namely, when the cleaning blade presses the photoconductor with the higher linear pressure, a product life of the photoconductor and the cleaning device is shortened from one-fifth to one-sixth as compared with a case in which the cleaning blade presses the photoconductor with the normal linear pressure.

On the other hand, the toner particles having a smaller particle diameter and a spherical shape may be removed from the surface of the photoconductor by using an electrostatic cleaning method. Furthermore, the surface of the photoconductor is prevented from being abraded by a mechanical rubbing by the cleaning blade.

Figure 2:
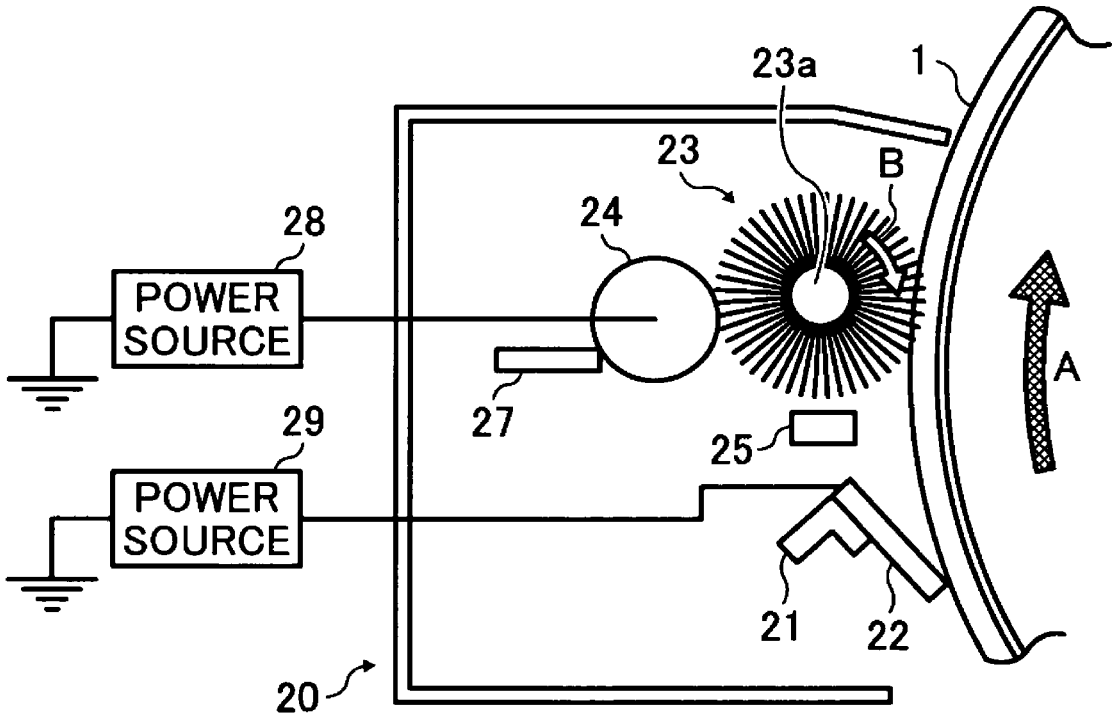
FIG. 2 is a schematic block diagram illustrating the cleaning device using the electrostatic cleaning method employed in the image forming apparatus illustrated in FIG. 1.

FIG. 2 is a simplified schematic block diagram illustrating the cleaning device 20 using the electrostatic cleaning method employed in the printer 100 according to example embodiments. The cleaning device 20 includes the cleaning brush 23, the collecting roller 24 to which a positive voltage is applied from a cleaning power source 28, and/or a collecting roller cleaning blade 27 to remove the residual toner particles collected by the collecting roller 24. The cleaning device 20 further includes a conductive blade 22 to control a charging polarity of the residual toner particles provided on an upstream side from a position where the cleaning brush 23 removes the residual toner particles from the surface of the photoconductor 1 relative to a rotation direction of the photoconductor 1. A negative voltage is applied to the conductive blade 22 from a blade power source 29. The cleaning device 20 further includes a cleaning device neutralizing lamp 25 to neutralize the surface of the photoconductor 1 provided on a downstream side from the conductive blade 22 and an upstream side from the cleaning brush 23 relative to a rotation direction of the photoconductor 1.

The cleaning brush 23 is rotated around a rotation axis 23*a* thereof in a direction indicated by an arrow B in FIG. 2. The cleaning power source 28 applies the positive voltage to the collecting roller 24, and the voltage is further applied to the cleaning brush 23 from the collection roller 24, so that the residual toner particles are removed from the surface of the photoconductor 1 to the cleaning brush 23. In addition to the cleaning power source 28, the cleaning device 20 may include a power source for directly applying a voltage to the rotation axis 23*a* of the cleaning brush 23.

The conductive blade 22 includes an elastic body including a material such as a polyurethane rubber, and has an electric resistivity of from $10^6$ to $10^8$ Ω·cm. The conductive blade 22 contacts the surface of the photoconductor 1 so as to face in the rotation direction of the photoconductor 1 at a contact angle of 20° with a contact pressure of from 20 to 40 g/cm, and an engagement of 0.6 mm. Here, the conductive blade 22 having an electric resistivity of $10^6$ Ωcm contacts the surface of the photoconductor 1 with a contact pressure of 20 g/cm. The conductive blade 22 has a flat shape with a thickness of 2 mm, a free length of 7 mm, a JIS-A hardness of from 60 to 80 degrees, and an impact resilience of 30%, and is bonded to a blade support member 21 including a steel plate. Because the conductive blade 22 contacts the surface of the photoconductor 1 with the lower contact pressure as described above, a larger number of the toner particles having a smaller particle diameter and a spherical shape pass through the contact portion between the conductive blade 22 and the photoconductor 1. However, the conductive blade 22 is provided not for the purpose of removing the residual toner particles from the surface of the photoconductor 1, but for the purpose of negatively charging the residual toner particles so that the cleaning brush 23 can remove the residual toner particles from the surface of the photoconductor 1. Therefore, the number of the toner particles passing through the contact portion between the conductive blade 22 and the photoconductor 1 does not matter.

The cleaning device neutralizing lamp 25 includes a plurality of light emitting diodes arranged at regular intervals.

A charge amount of the residual toner particles on the surface of the photoconductor 1 and a charging potential of the photoconductor 1 are described in detail below.

Figure 3:
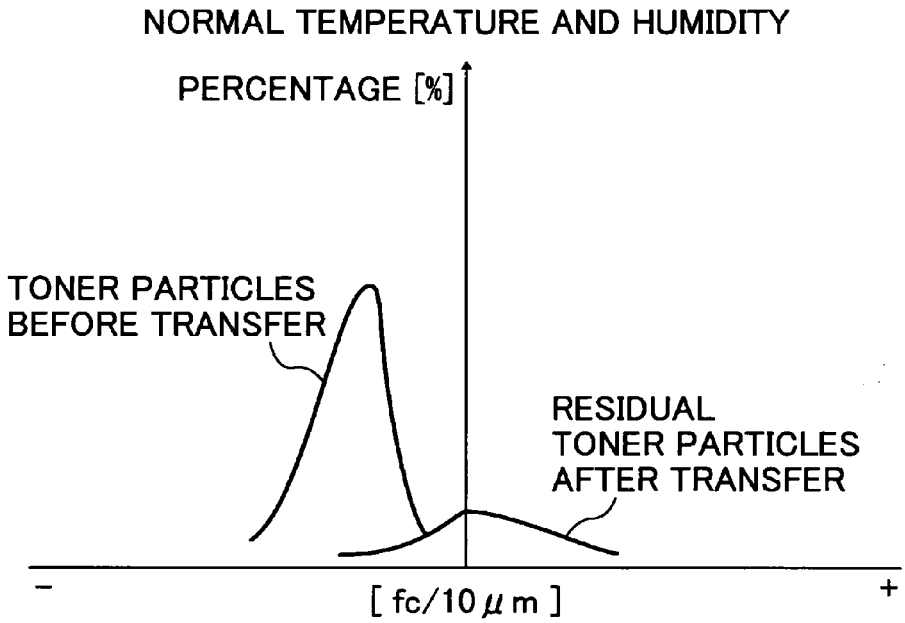
FIG. 3 is a graph illustrating charge distributions of toner particles on a surface of a photoconductor before and after transfer is performed at normal temperature and humidity.

FIG. 3 is a graph illustrating charge distributions of the toner particles on the surface of the photoconductor 1 before and after transfer is performed at normal temperature and humidity. The charge distributions of the toner particles are measured by using E-SPART analyzer manufactured by Hosokawa Micron Corporation. A vertical axis of the graph represents a percentage out of a total number of collected toner particles, and a horizontal axis represents a charge amount per toner particle. Here, only 500 toner particles are collected for the measurement due to a smaller number of the residual toner particles on the surface of the photoconductor 1.

As shown in FIG. 3, most of the toner particles on the surface of the photoconductor 1 before transfer is performed are negatively charged. Such toner particles are transferred onto the transfer sheet by a positive transfer bias applied to the transfer roller 15. However, most of the toner particles on the surface of the photoconductor 1 which are positively charged before transfer is performed remain on the surface of the photoconductor 1 even after transfer has been performed. Moreover, the polarity of a part of the toner particles on the surface of the photoconductor 1 which are negatively charged before transfer is performed may be reversed to positive due to the positive charge injected from the transfer roller 15. Accordingly, the residual toner particles on the surface of the photoconductor 1 after transfer has been performed have a broader charge distribution including both the positively charged toner particles and the negatively charged toner particles as shown in FIG. 3.

Figure 4:
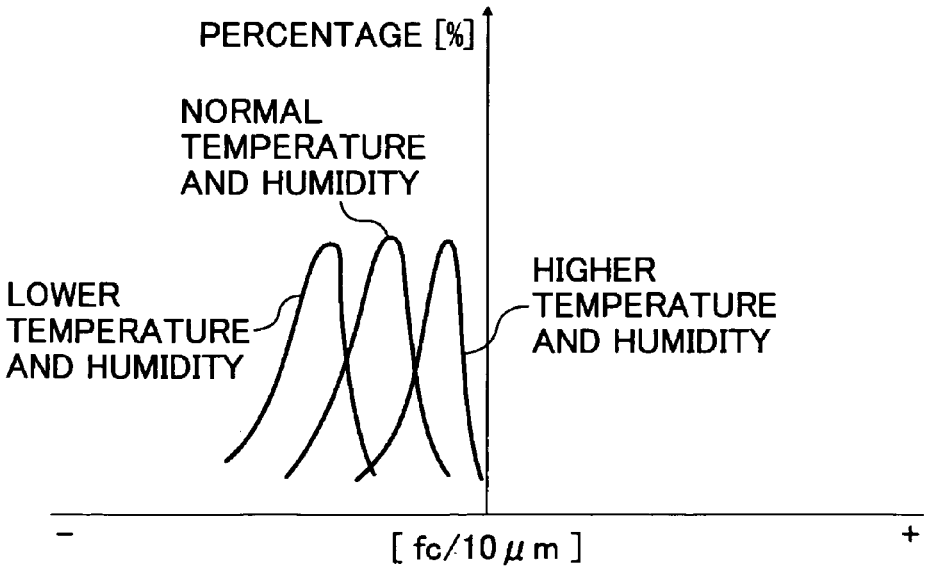
FIG. 4 is a graph illustrating charge distributions of toner particles on the surface of the photoconductor before transfer is performed under various environmental conditions.

The charge distributions of the toner particles on the surface of the photoconductor 1 under various environmental conditions are described in detail below. FIG. 4 is a graph illustrating the charge distributions of the toner particles on the surface of the photoconductor 1 before transfer is performed under environmental conditions at a higher temperature of 30° C. and a higher humidity of 90%, a normal temperature of 20° C. and a normal humidity of 50%, and a lower temperature of 10° C. and a lower humidity of 15%. Because the toner particles tend to be negatively charged at the lower temperature and humidity, an amount of negative toner charge increases under such an environmental condition. On the other hand, because the toner particles does not tend to be negatively charged at the higher temperature and humidity, the amount of negative toner charge decreases under such an environmental condition. Therefore, as shown in FIG. 4, the toner particles have a toner charge distribution with a higher negative polarity at the lower temperature and humidity as compared to the toner particles at the higher temperature and humidity. When the toner charge distribution changes depending on the environmental conditions before transfer is performed as described above, the toner charge distribution also changes depending on the environmental conditions after transfer has been performed.

Figure 5:
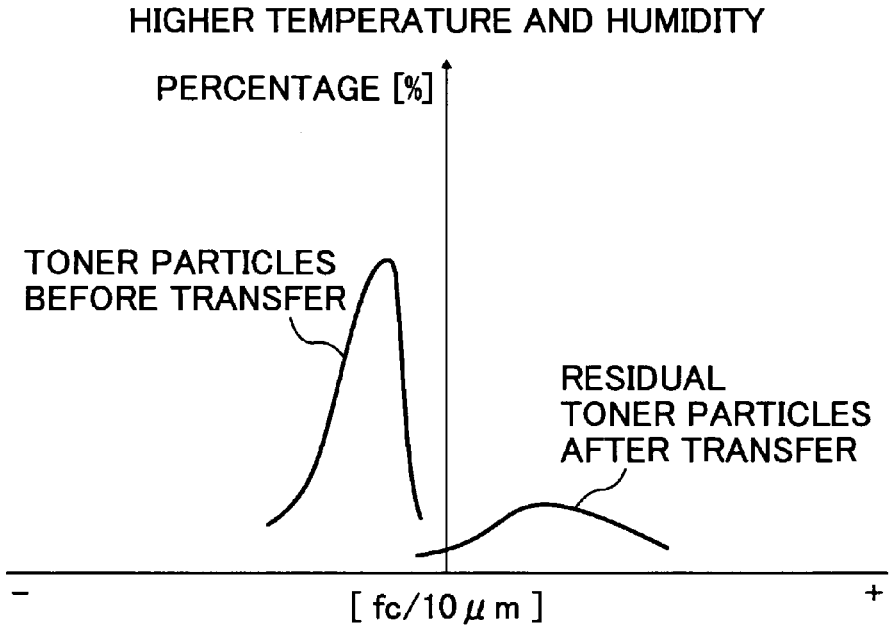
FIG. 5 is a graph illustrating charge distributions of toner particles on the surface of the photoconductor before and after transfer is performed at higher temperature and humidity.
Figure 6:
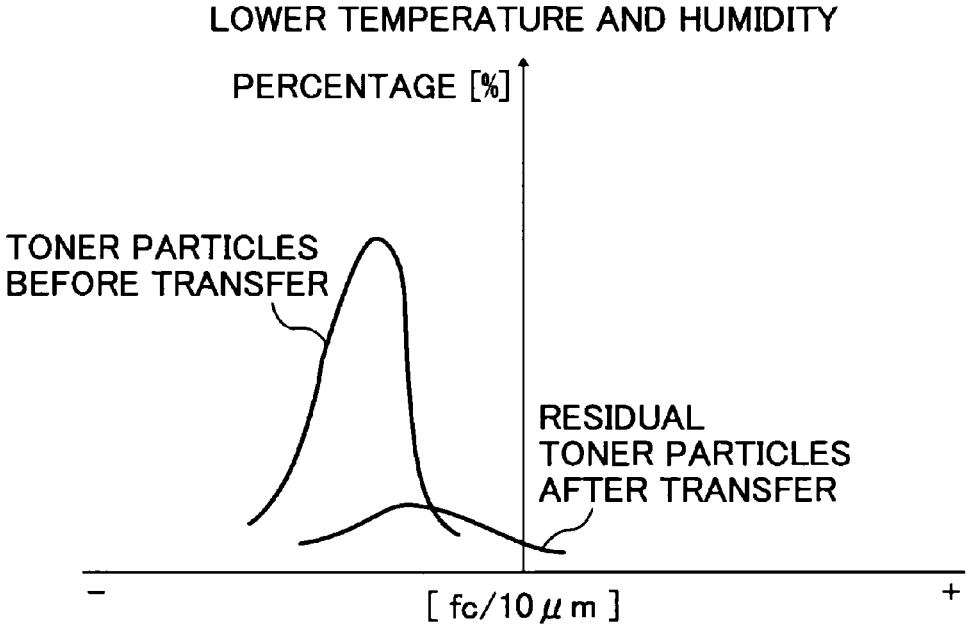
FIG. 6 is a graph illustrating charge distributions of toner particles on the surface of the photoconductor before and after transfer is performed at lower temperature and humidity.

FIG. 5 is a graph illustrating charge distributions of the toner particles on the surface of the photoconductor 1 before and after transfer is performed at the higher temperature and humidity. FIG. 6 is a graph illustrating charge distributions of the toner particles on the surface of the photoconductor 1 before and after transfer is performed at the lower temperature and humidity. As shown in FIGS. 3, 5, and 6, the amount of positive toner charge after transfer has been performed increases at the higher temperature and humidity as compared to that at the normal temperature and humidity, while an amount of negative toner charge after transfer has been performed increases at the lower temperature and humidity as compared to that at the normal temperature and humidity. In other words, the charge distribution of the toner particles on the surface of the photoconductor 1 after transfer has been performed is shifted toward the positive polarity side at the higher temperature and humidity.

Figure 7:
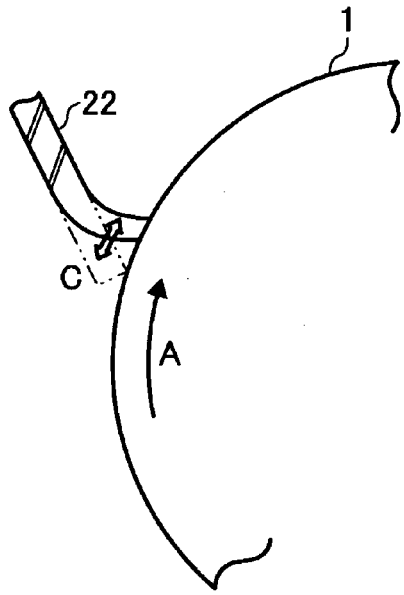
FIG. 7 is an enlarged schematic view illustrating a conductive blade when the photoconductor is rotated.

FIG. 7 is an enlarged schematic view illustrating the conductive blade 22 when the photoconductor 1 is rotated. Residual toner particles, which remain on the surface of the photoconductor 1 after transfer has been performed, are conveyed to a portion in contact with the conductive blade 22 by the rotation of the photoconductor 1, and a part of the residual toner particles is mechanically removed from the surface of the photoconductor 1 by the conductive blade 22. However, the other part of the residual toner particles remains on the surface of the photoconductor 1 due to a stick-slip motion of the conductive blade 22 indicated by a state C with a dotted line in FIG. 7.

Figure 8:
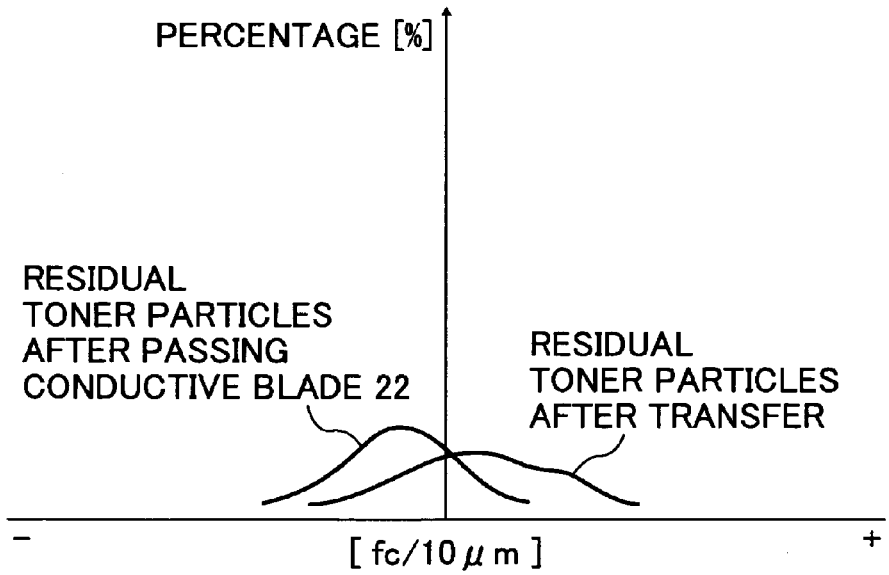
FIG. 8 is a graph illustrating charge distributions of residual toner particles on the surface of the photoconductor before and after the residual toner particles pass the conductive blade at normal temperature and humidity.

A higher negative voltage of, for example, −1,400 V, is applied to the conductive blade 22 from the blade power source 29 so that the positively charged residual toner particles are turned into the negatively charged toner particles. When the residual toner particles are sandwiched between the conductive blade 22 and the photoconductor 1, a negative current is applied to the residual toner particles from the conductive blade 22. Consequently, the residual toner particles are negatively charged, and pass through the contact portion between the conductive blade 22 and the photoconductor 1. Moreover, the residual toner particles are further negatively charged by an electric discharge from minute gaps at an entry and an exit of a wedge portion formed between the photoconductor 1 and the conductive blade 22. In other words, when passing through the contact portion between the conductive blade 22 and the photoconductor 1, the residual toner particles are negatively charged by the negative charge injected from the conductive blade 22. FIG. 8 is a graph illustrating charge distributions of the residual toner particles on the surface of the photoconductor 1 before and after the residual toner particles pass the conductive blade 22 at the normal temperature and humidity. As shown in FIG. 8, the charge distribution of the residual toner particles on the surface of the photoconductor 1 is shifted toward the negative polarity side by using the conductive blade 22. At the same time, the surface of the photoconductor 1 is negatively charged by the higher negative voltage applied to the conductive blade 22. It is required to apply such a higher negative voltage to the conductive blade 22 only in a case in which the charge distribution of the residual toner particles on the surface of the photoconductor 1 is considerably shifted toward the positive polarity side at the higher temperature and humidity as described above.

Thereafter, the surface of the photoconductor 1 and the residual toner particles thereon negatively charged by the conductive blade 22 are conveyed to the cleaning device neutralizing lamp 25 by the rotation of the photoconductor 1. The cleaning device neutralizing lamp 25 neutralizes the surface of the photoconductor 1 negatively charged by the conductive blade 22.

Figure 9:
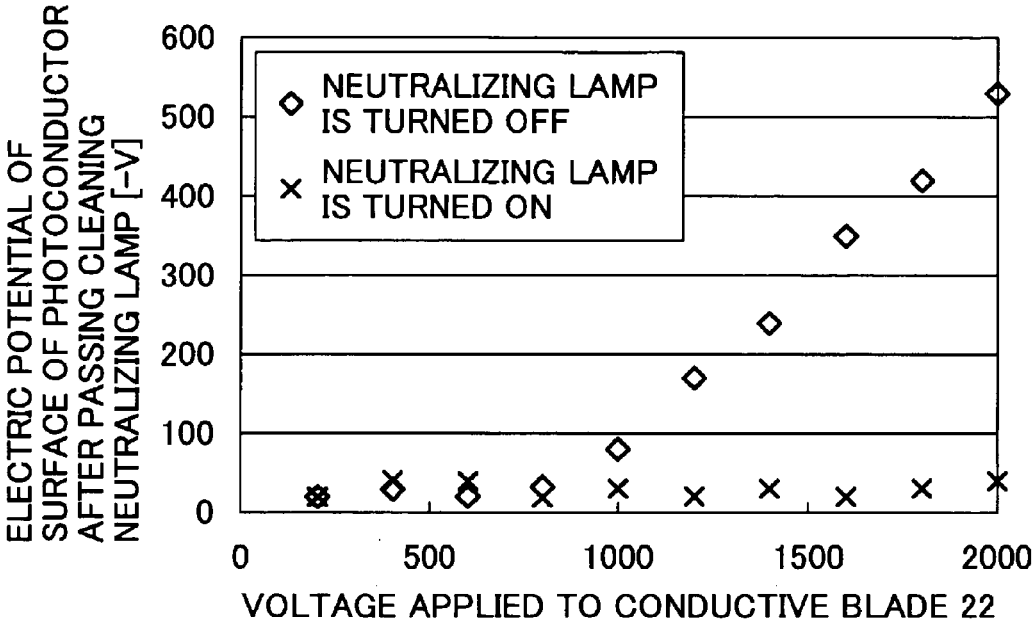
FIG. 9 is a graph illustrating a relation between a voltage applied to the conductive blade and an electric potential of the surface of the photoconductor after the surface of the photoconductor has passed a cleaning device neutralizing lamp.

FIG. 9 is a graph illustrating a relation between a voltage applied to the conductive blade 22 and an electric potential of the surface of the photoconductor 1 after the surface of the photoconductor 1 has passed the cleaning device neutralizing lamp 25. An electric potential of the surface of the photoconductor 1 when the cleaning device neutralizing lamp 25 is turned off is also shown in FIG. 9 for comparison. When a high voltage is applied to the conductive blade 22 without turning the cleaning device neutralizing lamp 25 on, the surface of the photoconductor 1 is negatively charged by the negative charge injected from the conductive blade 22. Even in such a case, the cleaning device neutralizing lamp 25 neutralizes the surface of the photoconductor 1 so that the electric potential of the surface of the photoconductor 1 approaches zero.

The negatively charged residual toner particles and the neutralized surface of the photoconductor 1 are conveyed to the cleaning brush 23. A voltage with the opposite polarity to that of the residual toner particles, namely, the positive voltage, is applied to the cleaning brush 23. The cleaning brush 23 electrostatically collects the residual toner particles remaining on the surface of the photoconductor 1 after the residual toner particles have passed the conductive blade 22.

In the related-art cleaning device without the cleaning device neutralizing lamp 25, the highly negatively charged surface of the photoconductor is conveyed to the cleaning brush to which the positive voltage is applied, causing a large gradient in an electric potential between the surface of the photoconductor and the cleaning brush. Consequently, a large amount of the positive current is applied to the residual toner particles on the surface of the photoconductor from the cleaning brush, so that the positive charge is injected into the residual toner particles from the cleaning brush. As a result, the polarity of the residual toner particles is reversed to positive again. Therefore, the cleaning brush does not provide electrostatic cleaning performance, causing cleaning residual toner particles. As a result, irregular images may be formed in next image forming operations due to the cleaning residual toner particles on the surface of the photoconductor, and adhesion of the cleaning residual toner particles to the charging roller.

On the other hand, according to example embodiments, the surface of the photoconductor 1 is neutralized by the cleaning device neutralizing lamp 25, so that an electric potential gradient between the surface of the photoconductor 1 and the cleaning brush 23 is sufficiently small. Therefore, the polarity of the residual toner particles is not reversed, so that the cleaning brush 23 removes the residual toner particles from the surface of the photoconductor 1.

Figure 10:
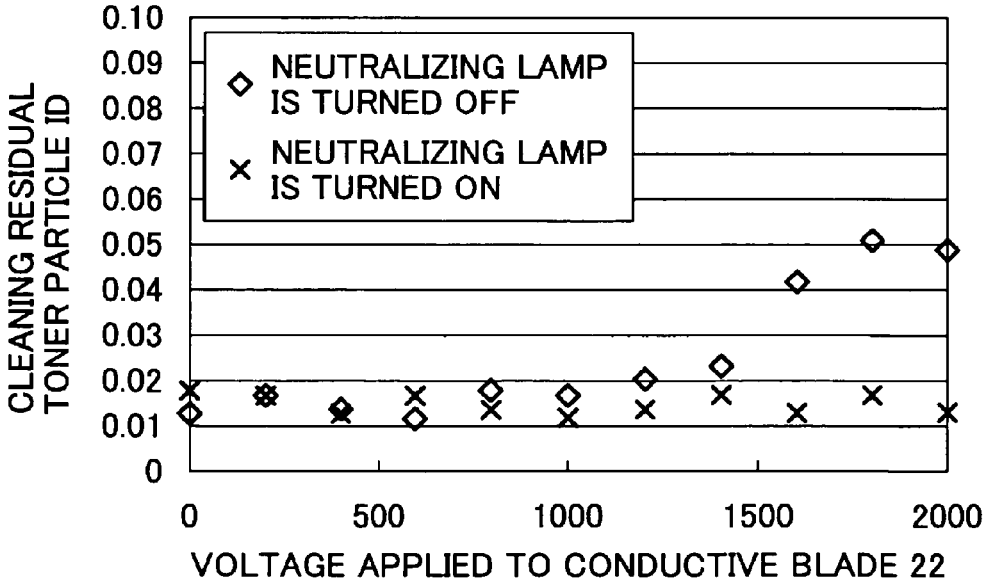
FIG. 10 is a graph illustrating a relation between the voltage applied to the conductive blade and a cleaning residual toner particle ID.

FIG. 10 is a graph illustrating a relation between a voltage applied to the conductive blade 22 and an image density of cleaning residual toner particles on the surface of the photoconductor 1 (hereinafter referred to as a "cleaning residual toner particle ID", to be described in detail later) when a voltage of +500 V is applied to the cleaning brush 23. As shown in FIG. 10, the cleaning residual toner particle ID does not increase by using the cleaning device neutralizing lamp 25 even when a high voltage is applied to the conductive blade 22. On the other hand, the cleaning residual toner particle ID increases without using the cleaning device neutralizing lamp 25 when a high voltage is applied to the conductive blade 22.

The toner particles removed from the surface of the photoconductor 1 to the cleaning brush 23 is moved to the collecting roller 24 with a positive potential higher than that of the cleaning brush 23. The toner particles on the collecting roller 24 are removed by the collecting roller cleaning blade 27, and are discharged from the cleaning device 20 with the toner discharging screw 19, or are returned to the developing device 6.

Figure 11:
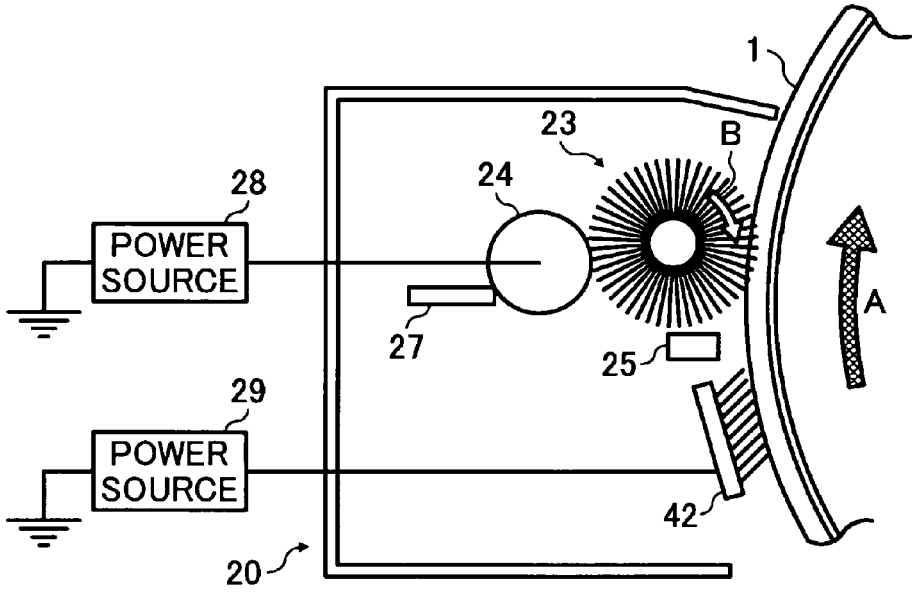
FIG. 11 is a schematic view illustrating another example of the cleaning device.
Figure 12:
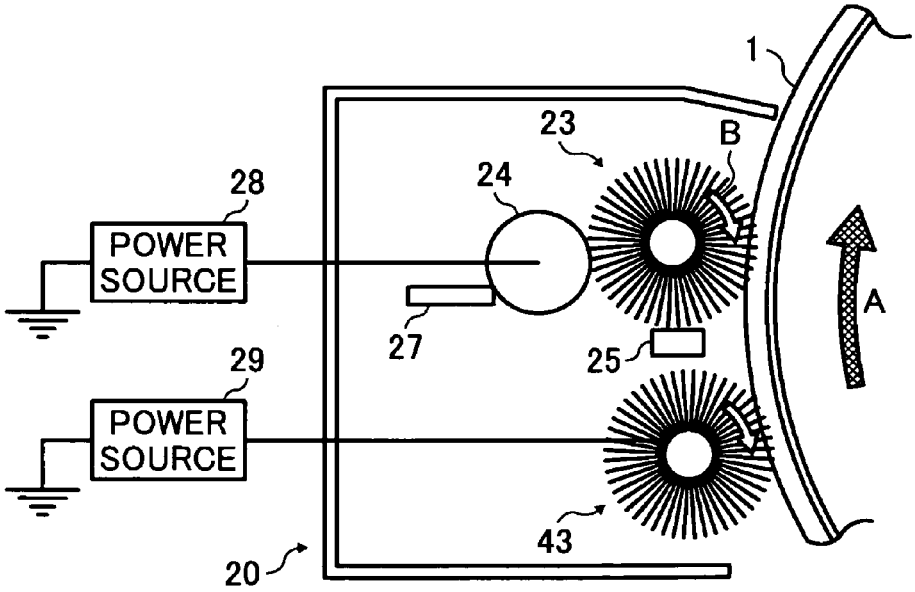
FIG. 12 is a schematic view illustrating yet another example of the cleaning device.

As long as controlling the residual toner particles on the surface of the photoconductor 1 to have the negative polarity, a corona charger 42 shown in FIG. 11, a brush roller 43 shown in FIG. 12, and so forth, may also be used in place of the conductive blade 22. However, because the conductive blade 22 preliminary removes the residual toner particles in a simple way prior to electrostatic cleaning performed by the cleaning brush 23, it may be beneficial to employ the conductive blade 22 in example embodiments.

Figure 13:
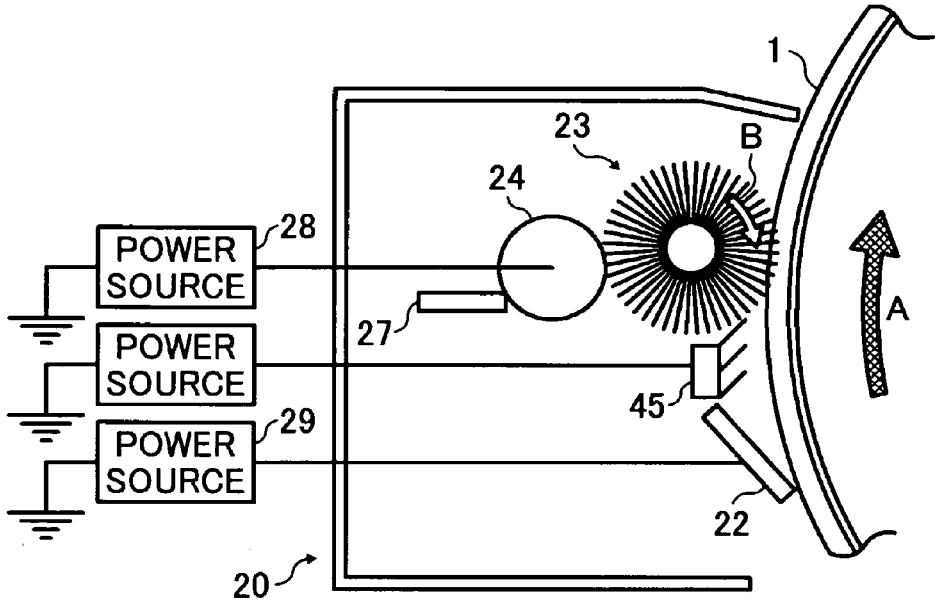
FIG. 13 is a schematic view illustrating yet another example of the cleaning device.
Figure 14:
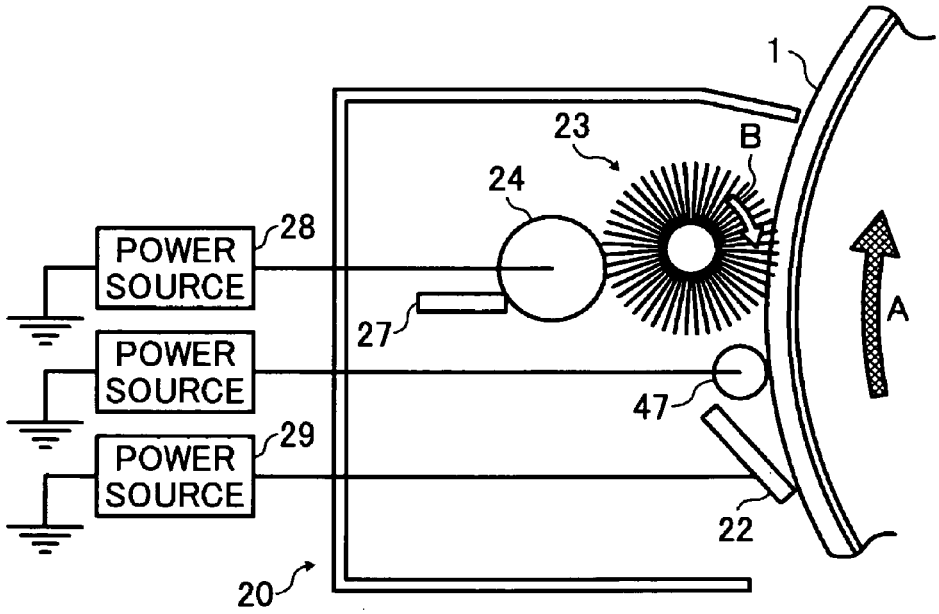
FIG. 14 is a schematic view illustrating yet another example of the cleaning device.

As long as neutralizing the surface of the photoconductor 1, a corona charger 45 shown in FIG. 13, a charging roller 47 shown in FIG. 14, and so forth, may also be used in place of the cleaning device neutralizing lamp 25. However, it may be beneficial to employ the cleaning device neutralizing lamp 25 as a neutralizing member according to example embodiment because the use of the cleaning device neutralizing lamp 25 does not affect the potential of the residual toner particles on the surface of the photoconductor 1.

Figure 15:
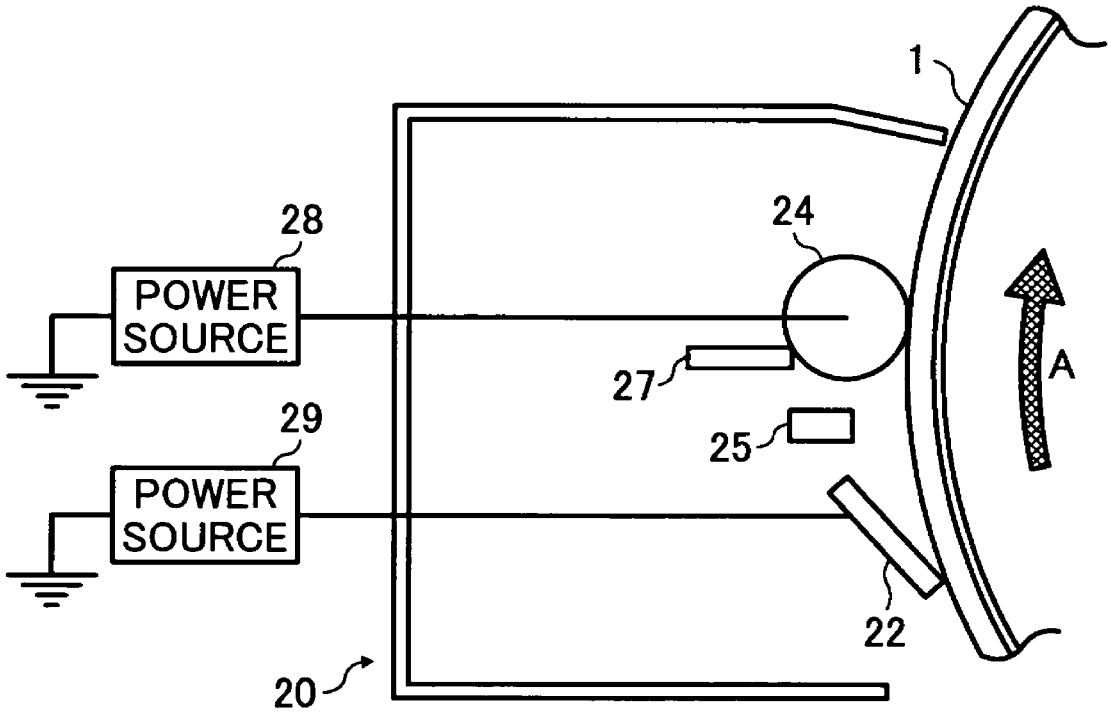
FIG. 15 is a schematic view illustrating yet another example of the cleaning device.

As long as electrostatically removing the residual toner particles on the surface of the photoconductor 1, the collecting roller 24 shown in FIG. 15 and so forth may also be used in place of the cleaning brush 23. However, it may be beneficial to employ the cleaning brush 23 in example embodiments because the cleaning brush 23 has a larger contact area with the residual toner particles so as to effectively remove the residual toner particles from the surface of the photoconductor 1.

As described above, the amount of positive charge injected into the residual toner particles from the cleaning brush 23 may be reduced with the use of the cleaning device neutralizing lamp 25. As a result, the cleaning residual toner particles may be efficiently removed from the surface of the photoconductor 1.

In addition, the amount of positive charge injected into the residual toner particles from the cleaning brush 23 may be reduced by a structure of a brush string included in the cleaning brush 23. A relation between a structure of a brush string 31 included in the cleaning brush 23 and the charge injection is described in detail below.

Figure 16:
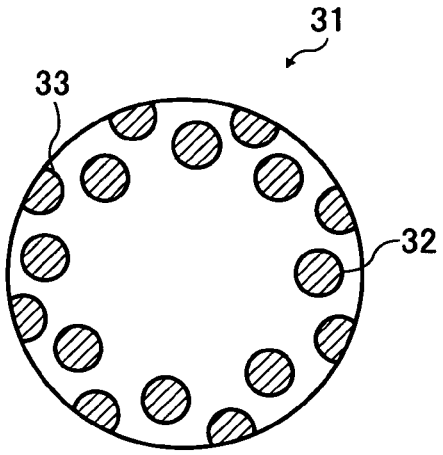
FIG. 16 RELATED ART
FIG. 16 is a cross-sectional view illustrating an example of a brush string of the cleaning brush used in a related-art cleaning device.
Figure 17:
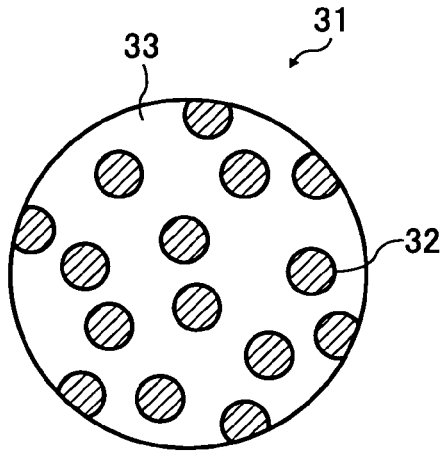
FIG. 17 RELATED ART
FIG. 17 is a cross-sectional view illustrating another example of the brush string of the cleaning brush used in the related-art cleaning device.

It is thought that the positive charge is injected into the residual toner particles through a conductive material 32 included in the brush string 31. FIGS. 16 and 17 are cross-sectional views illustrating the brush string 31 of the cleaning brush 23 which is widely used. In the brush string 31 shown in FIGS. 16 and 17, a conductive material 32 is dispersed into an insulating material 33 provided in a surface layer of the brush string 31. Because the conductive material 32 may easily contact the residual toner particles, the positive charge is frequently injected into the residual toner particles when the cleaning brush 23 having the brush string 31 shown in FIGS. 16 and 17 removes the residual toner particles.

Figure 18:
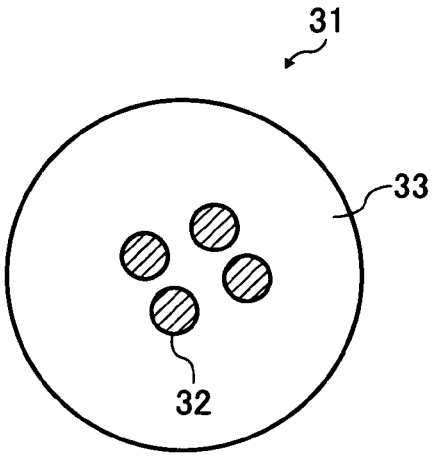
FIG. 18 is a cross-sectional view illustrating an example of the brush string of the cleaning brush used in the cleaning device according to example embodiments.
Figure 19:
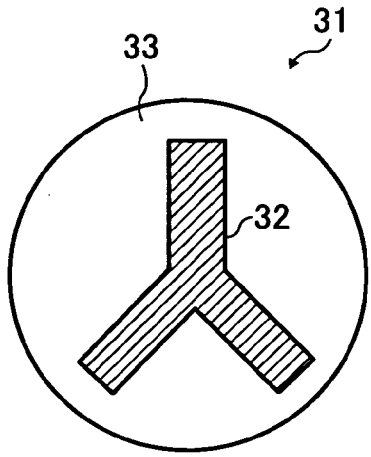
FIG. 19 is a cross-sectional view illustrating another example of the brush string of the cleaning brush used in the cleaning device according to example embodiments.
Figure 20:
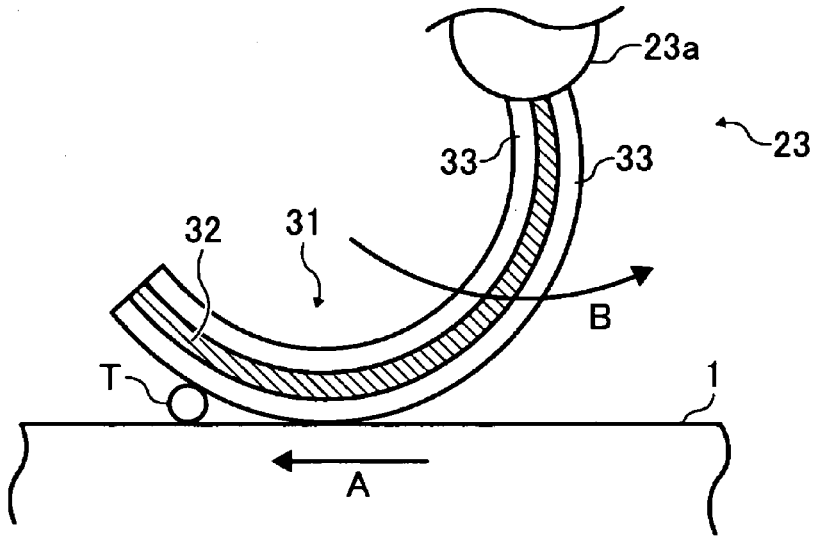
FIG. 20 is a vertical sectional view illustrating a piece of the brush string having a bent shape.

FIG. 18 is a cross-sectional view illustrating an example of the brush string 31 of the cleaning brush 23 included in the cleaning device 20, and FIG. 19 is a cross-sectional view illustrating another example of the brush string 31 thereof. FIG. 20 is a vertical sectional view illustrating a piece of the brush string 31 in contact with the surface of the photoconductor 1. Referring to FIGS. 18, 19, and 20, the cleaning string 31 has a core-in-sheath type structure including the conductive material 32 and the insulating material 33 provided on the conductive material 32. Because the brush string 31 having the core-in-sheath type structure includes the insulating material 33 in an outermost surface thereof, the conductive material 32 does not contact a toner particle T with a portion other than a cutting surface of the brush string 31. Thereby, the charge injection into the toner particle T from the cleaning brush 23 may be suppressed.

Insulating materials such as nylon, polyester, and acrylic are widely used as the insulating material 33 included in the brush string 31. All of the above-described insulating materials may suppress the charge injection into the toner particles T from the cleaning brush 23. Specific examples of the brush string having a core-in-sheath type structure have been disclosed in published unexamined Japanese patent application (hereinafter referred to as "JP-A") No. 10-310974, JP-A No. 10-131035, JP-A No. 01-292116, published examined Japanese patent application (hereinafter referred to as "JP-B)" No. 07-033637, JP-B No. 07-033606, and JP-B No. 03-064604.

Referring to FIG. 20, the brush string 31 is bent backward relative to a rotation direction of the cleaning brush 23 indicated by an arrow B.

Figure 21:
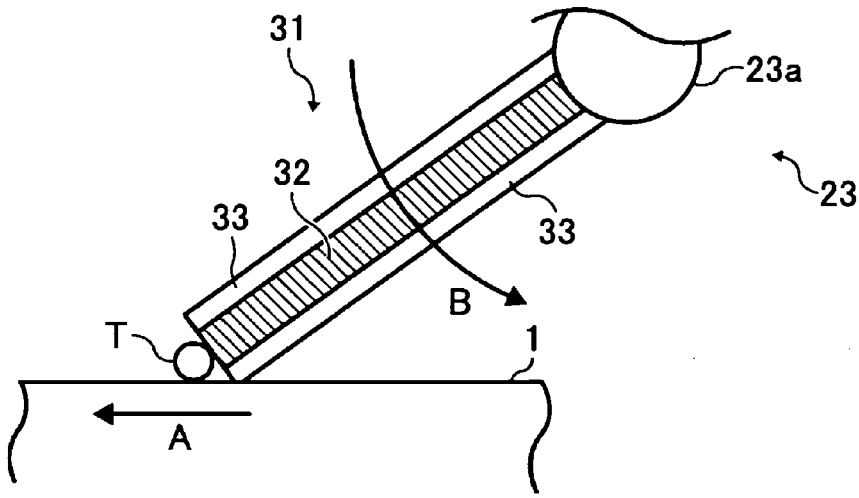
FIG. 21 is a vertical sectional view illustrating a piece of the brush string having a straight shape.

FIG. 21 is a vertical sectional view illustrating the brush string 31 having a straight shape. The brush string 31 includes a core-in-sheath type structure including the conductive material 32 and the insulating material 33 provided on the conductive material 32, and is fixed to the brush rotation axis 23*a* in a radial pattern. An arrow B shown in FIG. 21 represents the rotation direction of the cleaning brush 23, namely a moving direction of the brush string 31. When the brush string 31 has a straight shape, the conductive material 32 contacts the toner particle T with a cutting surface at a leading edge of the brush string 31. As a result, the positive charge may be injected into the toner particle T from the cleaning brush 23.

On the other hand, when the brush 31 has a bent shape, the conductive material 32 included in the brush string 31 hardly contacts the toner particle T as shown in FIG. 20. Therefore, the charge injection from the cleaning brush 23 to the residual toner particles may be suppressed when the toner particles are removed from the surface of the photoconductor 1 to the cleaning brush 23, and from the cleaning brush 23 to the collecting roller 24.

As described above, a potential gradient between the surface of the photoconductor 1 and the cleaning brush 23 may be reduced by using the cleaning device neutralizing lamp 25, achieving suppression of the positive charge injection into the residual toner particles. Thus, any one of the examples of the cleaning brush 23 described above is applicable to example embodiments. However, in order to more efficiently suppress the positive charge injection into the residual toner particles, it may be beneficial to use the cleaning brush 23 including the brush string 31 having the core-in-sheath type structure shown in FIGS. 18 and 19, and the bent shape shown in FIG. 20.

Figure 22:
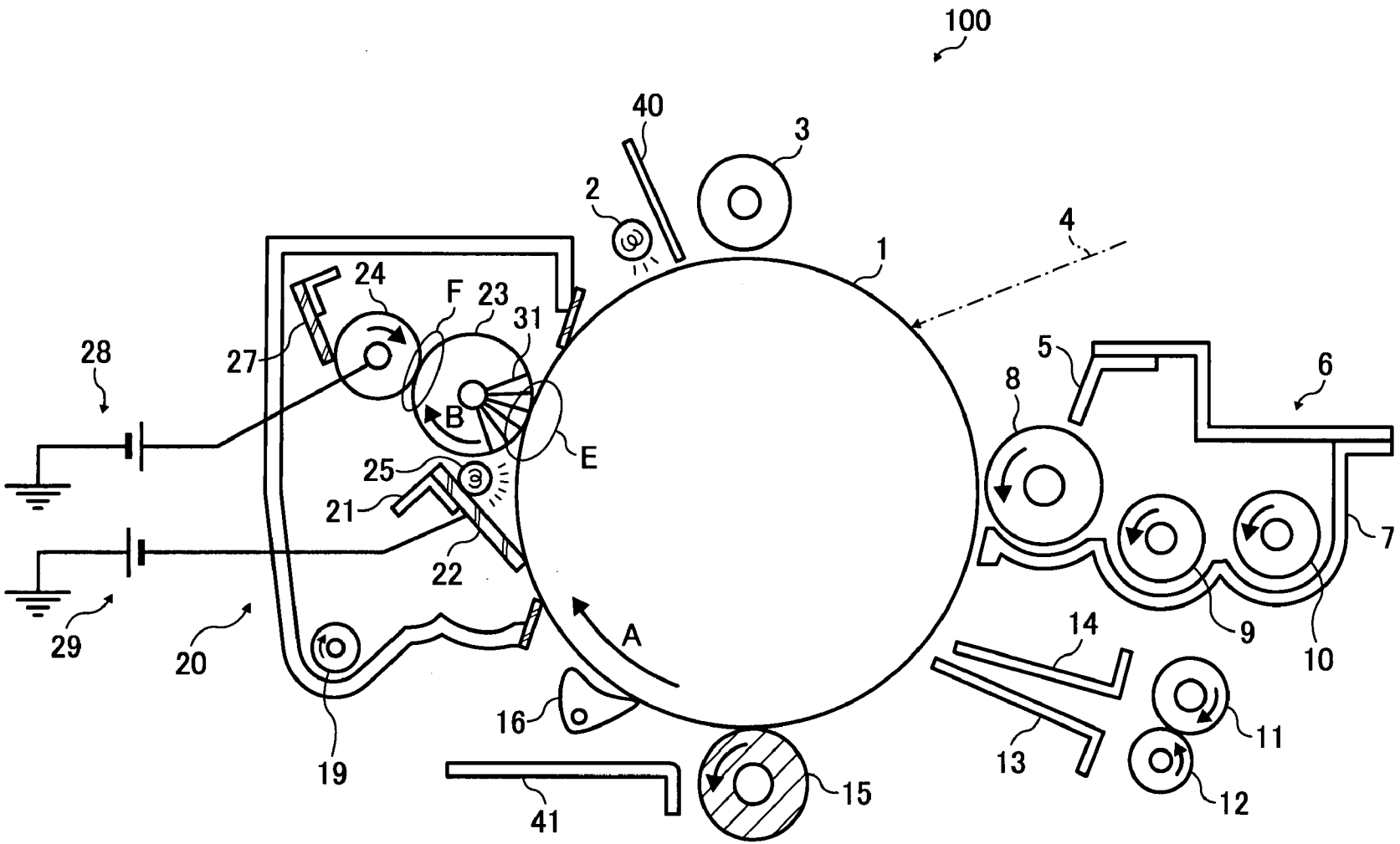
FIG. 22 is a schematic view illustrating areas where a charge injection occurs due to the use of the cleaning brush.

Areas where the charge injection occurs are described in detail below with reference to FIG. 22. FIG. 22 is a schematic view illustrating the image forming apparatus according to example embodiments in which the cleaning brush 23 includes the brush string 31 having the straight shape. The voltage applied from the cleaning power source 28 to the collecting roller 24 is further applied to the cleaning brush 23 from the collecting roller 24, so that the residual toner particles are removed from the surface of the photoconductor 1 to the cleaning brush 23.

The positive charge is injected into the residual toner particles in areas E and F in FIG. 22. The positive charge is injected into the residual toner particles in the area E when the conductive material 32 included in the brush string 31 contacts the residual toner particles. Because the polarity of the residual toner particles with a smaller amount of charge is reversed to that of the applied voltage, such residual toner particles are not removed by the cleaning brush 23, and remain on the surface of the photoconductor 1, resulting in the cleaning residual toner particles. On the other hand, although the charge is injected into the residual toner particles with a larger amount of charge, the polarity of such residual toner particles is not reversed, so that the residual toner particles are removed from the surface of the photoconductor 1 to the cleaning brush 23.

The removed toner particles with the polarity opposite to that of the applied voltage are further removed from the cleaning brush 23 to the collecting roller 24. At this time, the charge injection occurs in the area F between the cleaning brush 23 and the collecting roller 24 in the same manner as described above. For example, the polarity of the toner particles with a smaller amount of charge is reversed to that of the applied voltage, so that the toner particles are not removed from the cleaning brush 23 to the collecting roller 24, and remain on the cleaning brush 23. Thereafter, the toner particles remaining on the cleaning brush 23 contact the surface of the photoconductor 1 along with the rotation of the cleaning brush 23, and adhere to the surface of the photoconductor 1 again, resulting in the cleaning residual toner particles. However, the conductive material 32 hardly contacts the toner particles with the use of the cleaning brush 23 including the brush string 31 having the core-in-sheath type structure and the bent shape. Accordingly, the charge injection may be suppressed in the areas between the photoconductor 1 and the cleaning brush 23, and the cleaning brush 23 and the collecting roller 24.

An occurrence of the charge injection in the areas E and F has been observed as described below.

Figure 23:
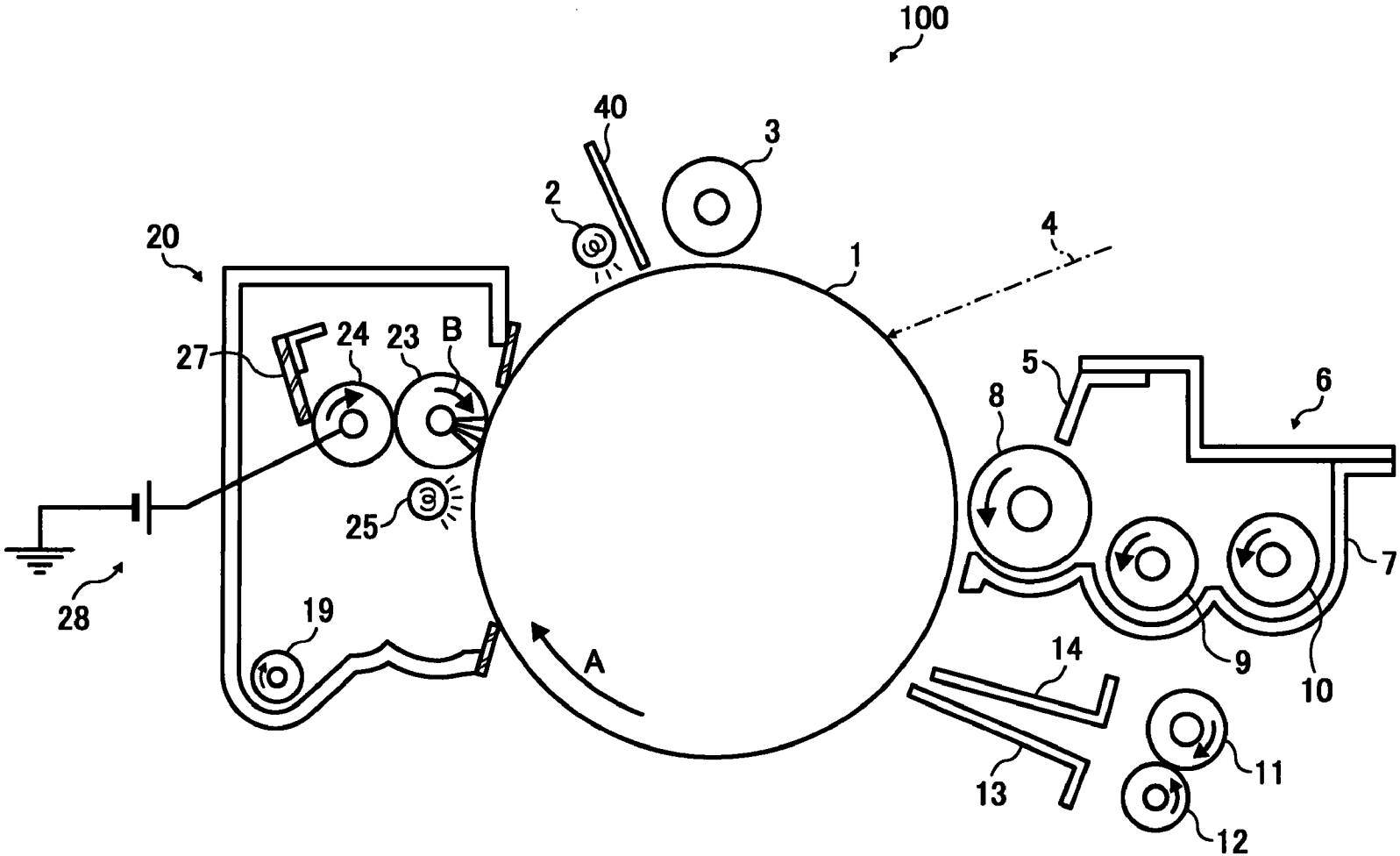
FIG. 23 is a schematic view illustrating the image forming apparatus in which a transfer roller and the conductive blade are removed from the configuration shown in FIG. 22.

FIG. 23 is a schematic view illustrating the image forming apparatus according to example embodiments in which the transfer roller 15 and the conductive blade 22 are removed from the configuration shown in FIG. 22, so that the toner particles are substantially 100 percent negatively charged after development has been performed, and are removed by the cleaning brush 23. The rotation of the photoconductor 1 is stopped when the cleaning brush 23 is rotated two revolutions after the leading edge of the toner image on the surface of the photoconductor 1 reaches the portion where the cleaning brush 23 and the surface of the photoconductor 1 contact each other. Subsequently, a charge amount of the toner particles on the surface of the photoconductor 1 per a length twice as long as a perimeter of the cleaning brush 23 is measured. The charge injection occurs between the cleaning brush 23 and the collecting roller 24 because the cleaning brush 23 and the collecting roller 24 contact each other once when the cleaning brush 23 is rotated one revolution to collect the residual toner particles on the surface of the photoconductor 1 and contacts the surface of the photoconductor 1 again. Therefore, an occurrence of the charge injection between the surface of the photoconductor 1 and the cleaning brush 23 may be observed by measuring the charge amount of the toner particles on the surface of the photoconductor 1 when the cleaning brush 23 is rotated two revolutions.

Figure 24:
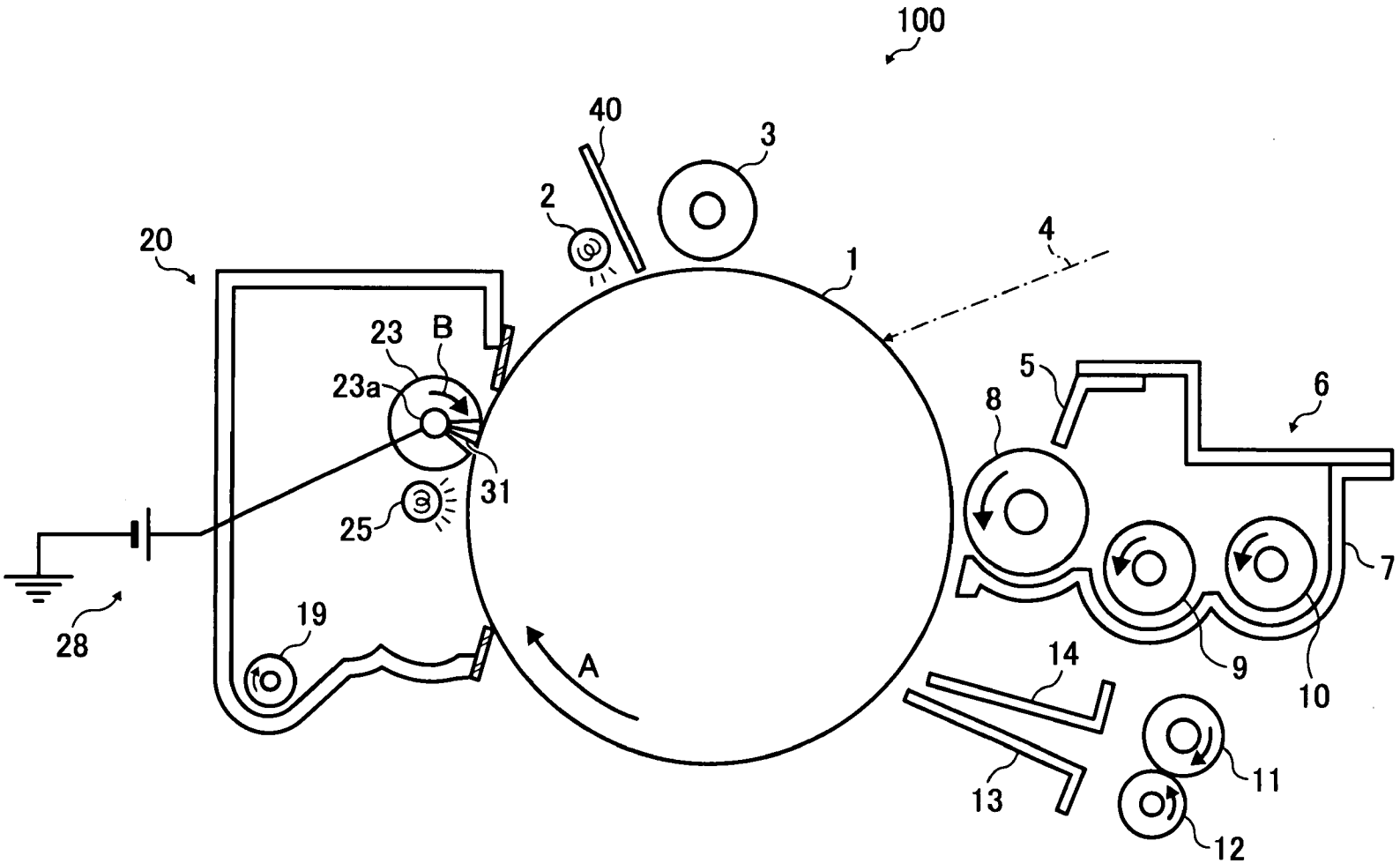
FIG. 24 is a schematic view illustrating the image forming apparatus in which a collecting roller and a collecting roller cleaning blade are removed from the configuration shown in FIG. 23.

FIG. 24 is a schematic view illustrating the image forming apparatus according to example embodiments in which the collecting roller 24 and the collecting roller cleaning blade 27 are removed from the configuration shown in FIG. 23, and a voltage is applied to the brush rotation axis 23*a* of the cleaning brush 23. With such a configuration, it may be confirmed that the charge injection mainly occurs between the cleaning brush 23 and the collecting roller 24. Similarly to the case with the configuration shown in FIG. 23, the rotation of the photoconductor 1 is stopped when the cleaning brush 23 is rotated two revolutions. In the configuration shown in FIG. 24, the brush string 31 having the straight shape is used in the cleaning brush 23. On the other hand, FIG. 25 is a schematic view illustrating the image forming apparatus according to example embodiments with the same configuration as that of FIG. 24, except that the brush string 31 having the bent shape is used in the cleaning brush 23.

Figure 25:
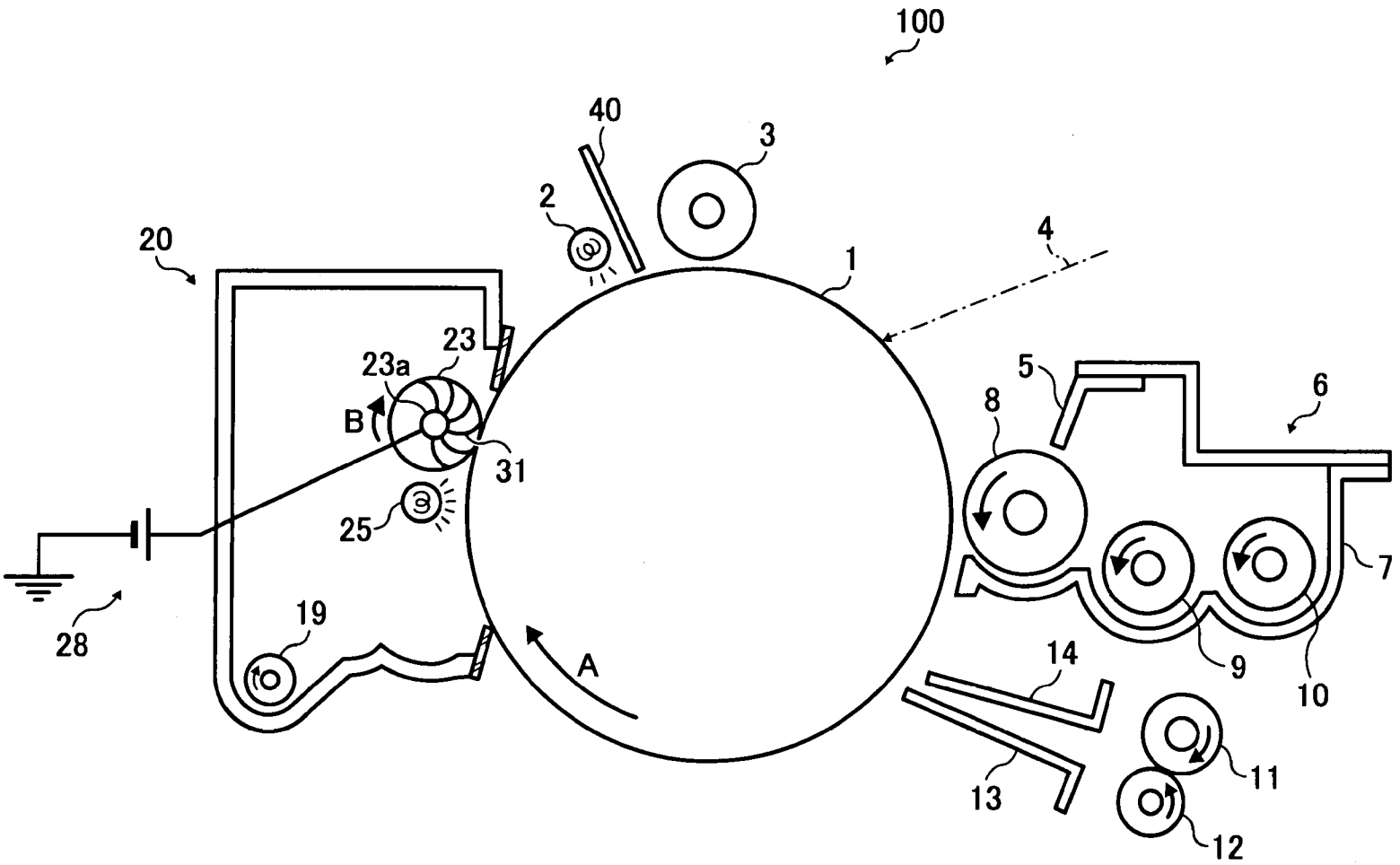
FIG. 25 is a schematic view illustrating the image forming apparatus with the same configuration as that of FIG. 24, except that the brush string having a bent shape is used in the cleaning brush.
Figure 26:
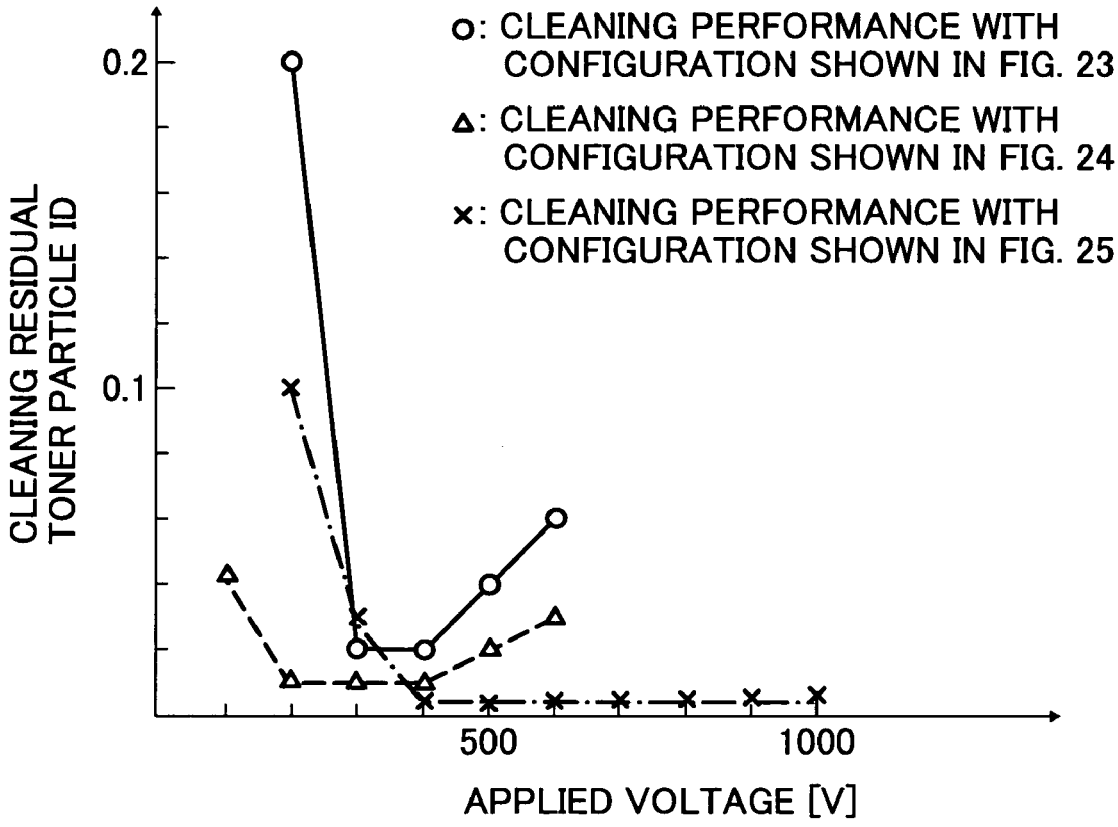
FIG. 26 is a graph comparing cleaning performance with the configurations shown in FIGS. 23 to 25.

FIG. 26 is a graph comparing cleaning performance with the configurations shown in FIGS. 23 to 25. A horizontal axis represents a voltage applied to the collecting roller 24 or the cleaning brush 23, and a vertical axis represents a cleaning residual toner particle ID. The cleaning residual toner particle ID is obtained as described below. The toner particles remaining on the surface of the photoconductor 1 after cleaning has been performed by the cleaning brush 23 are transferred onto a SCOTCH® tape. Subsequently, the SCOTCH® tape with the transferred toner particles thereon is put on a paper to measure a reflection density thereof with a spectro-colorimeter X-RITE manufactured by AMTEC Japan Co., Ltd. Meanwhile, only a SCOTCH® tape is put on a paper to measure a reflection density thereof with the spectro-colorimeter. The cleaning residual toner particle ID is obtained by subtracting the reflection density of the SCOTCH® tape from the reflection density of the SCOTCH® tape with the transferred toner particles thereon. The cleaning residual toner particle ID has a correlation with the number of toner particles, and a value of the cleaning residual toner particle ID increases as an increase in the number of toner particles. Therefore, the cleaning performance may be judged by the value of the cleaning residual toner particle ID.

As shown in FIG. 26, the value of the cleaning residual toner particle ID decreases with the configuration shown in FIG. 24 as compared with that shown in FIG. 23. The value of the cleaning residual toner particle ID further decreases with the configuration shown in FIG. 25 as compared with that shown in FIG. 24. The cleaning residual toner particle ID when the applied voltage is increased represents the toner particles into which the charge with the polarity of the applied voltage (e.g., positive charge) is injected. On the other hand, the cleaning residual toner particle ID when the applied voltage is decreased represents the toner particles which cannot be removed by the cleaning brush 23. The cleaning residual toner particle ID when a voltage of 500 V or more is applied to the collecting roller 24 or the cleaning brush 23 represents positively charged toner particles. On the other hand, the cleaning residual toner particle ID when a voltage of 200 V or less, or a voltage of 100 V or less in the configuration shown in FIG. 24, is applied to the collecting roller 24 or the cleaning brush 23 represents negatively charged toner particles. Therefore, it is confirmed that the charge injection occurs between the photoconductor 1 and the cleaning brush 23, and the cleaning brush 23 and the collecting roller 24, respectively. In addition, the result of the cleaning performance with the configuration of FIG. 25 shown in FIG. 26 proves that the charge injection hardly occurs with the use of the cleaning brush 23 including the brush string 31 having the core-in-sheath type structure and the bent shape.

A specific example of the configuration of the cleaning brush 23 and the collecting roller 24 applicable to example embodiments is described in detail below. The collecting roller 24 includes a SUS, and has a diameter of 10 mm. The cleaning brush 23 includes a conductive polyester, and contacts the surface of the photoconductor 1 with an engagement of 1 mm. The brush string 31 has a width of 5 mm and a length of 5 mm, and has a resistivity of $10^8$ Ω·m. The cleaning brush 23 has a density of 100,000 strings per square inch.

A specific example of the configuration of the collecting roller cleaning blade 27 applicable to example embodiments is described in detail below. The collecting roller cleaning blade 27 includes a polyurethane rubber, and contacts the cleaning brush 23 at an angle of 20 degrees with an engagement of 1 mm.

A bending angle of the brush string 31 differs depending on the diameters of the photoconductor 1 and the collecting roller 24. Thus, the bending angle of the brush string 31 may be appropriately set such that the conductive material 32 of the brush string 31 does not contact the photoconductor 1 and the collecting roller 24. In order to obtain the cleaning brush 23 having the bent brush string, the cleaning brush 23 in which the straight brush string is radially provided to the brush rotation axis 23*a* is put in a jig having the same inner diameter as that of the cleaning brush 23 to be rotated therein while being heated by the jig. As a result, the brush string 31 is permanently deformed to the bent shape. Therefore, a length of the brush string 31 having the bent shape from the leading edge thereof to the brush rotation axis 23*a* is required to be longer than that having the straight shape. Not only the brush string 31 having the bent shape, but also the brush string 31 having the straight shape in which a length from the leading edge thereof to the brush rotation axis 23*a* is sufficiently longer than a distance from the brush rotation axis 23*a* to the surface of the photoconductor 1, and only a side surface thereof contacts the photoconductor 1, may suppress the contact between the leading edge of the brush string 31 and the toner particles when the cleaning brush 23 is rotated in a counter direction relative to the rotation of the photoconductor 1. As a result, the charge injection from the cleaning brush 23 into the toner particles may be suppressed.

In a case in which toner particles having a spherical shape are used, the number of the toner particles removed from the surface of the photoconductor 1 by the conductive blade 22 becomes smaller as compared with a case in which pulverized toner particles are used. However, because the toner particles remaining on the surface of the photoconductor 1 are negatively charged by the conductive blade 22 as described above, the cleaning brush 23 effectively removes the residual toner particles from the surface of the photoconductor 1, to improve the cleaning performance.

The following describes that the collecting roller 24 may remove the toner particles from the cleaning brush 23. The collecting roller 24 removes the toner particles adhered to the cleaning brush 23 to the collecting roller 24 by using a potential gradient between the cleaning brush 23 and the collecting roller 24. Thus, as long as the surface thereof includes a conductive material, the collecting roller 24 may includes any material, for example, a material other than a photoconductive material. Accordingly, the surface of the collecting roller 24 may be coated with a material having a low friction coefficient, or a metal roller covered with a conductive tube with a low friction coefficient may be used as the collecting roller 24, so that the toner particles having a spherical shape can be easily removed from the cleaning brush 23. For example, the collecting roller 24, which is coated with a fluorine resin and a PVDF, or is covered with a PFA tube, may be used.

In addition, the surface of the collecting roller 24 may include an insulating material. In such a case, a voltage is separately applied to the cleaning brush 23 and the collecting roller 24. Specific examples of the insulating material included in the surface of the collecting roller 24 include a PVDF tube, a PI tube, an acrylic rubber, a silicone rubber, a ceramic, and so forth. In such a case, voltages applied to the conductive blade 22, the cleaning brush 23, and the collecting roller 24 are set to −400 V, +450 V, and +750 V, respectively. The values of the voltage may be appropriately set based on the usage conditions.

For the purpose of confirming the effect of using the cleaning device neutralizing lamp 25, images have been formed on sheets by using the image forming apparatus shown in FIG. 1 to evaluate the cleaning performance. The images have been formed on 40,000 sheets of A4 size paper with Ricoh Imagio Neo C600, at a high temperature of 30° C. and a high humidity of 80%. Under such a condition with the high temperature and humidity, it is difficult to control the polarity of the toner particles by using the conductive blade 22. A voltage of −1,600 V has been applied to the conductive blade 22 to control the polarity of the toner particles. Moreover, the images have been formed under a condition in which a larger number of toner particles on the surface of the photoconductor 1 have been conveyed to the cleaning device 20 without being transferred onto the sheets by the transfer roller 15. For comparison, the images have been formed under the conditions in which the cleaning device neutralizing lamp 25 has been turned on, and the cleaning device neutralizing lamp 25 has not been turned on.

As a result of the above-described experiment, proper images have been obtained when the cleaning device neutralizing lamp 25 has been turned on. On the other hand, images in which a toner is adhered to a background portion thereof have been obtained when the cleaning device neutralizing lamp 25 has not been turned on.

In the case in which the cleaning device neutralizing lamp 25 is not turned on, a larger potential gradient occurs between the photoconductor 1 and the cleaning brush 23 when the residual toner particles on the surface of the photoconductor 1 pass the cleaning brush 23. In order to compensate the potential gradient, a sufficient current flows through the residual toner particles between the photoconductor 1 and the cleaning brush 23, so that the positive charge is injected into the residual toner particles. As a result, the polarity of the residual toner particles is reversed to positive. Therefore, it is thought that the residual toner particles, the polarity of which is reversed to positive, may not be collected by the cleaning brush 23 with the positive polarity, causing a fouling in the background portion of the images. On the other hand, in the case in which the cleaning device neutralizing lamp 25 is turned on, a potential gradient between the photoconductor 1 and the cleaning brush 23 does not become large, so that the polarity of the residual toner particles is not reversed to positive. As a result, the residual toner particles may be reliably collected by the cleaning brush 23, providing the proper images.

An example embodiment and operations of the photoconductor 1 employed in the image forming apparatus according to example embodiments is described in detail below. The photoconductor 1 used in example embodiments may include an amorphous silicon photoconductor (hereinafter referred to as an "a-Si photoconductor"). A conductive support is heated to from 50° C. to 400° C., and a photoconductive layer including an amorphous silicon (hereinafter referred to as an "a-Si") is formed on the conductive support by using a film formation method such as a vacuum evaporation method, a sputtering method, an ion plating method, a thermal CVD method, an optical CVD method, and a plasma CVD method. Among the above-described examples, the plasma CVD method, in which a gas is decomposed by a direct-current, or a high-frequency glow discharge or a microwave glow discharge to form an a-Si sedimentary film on the conductive support, may be used.

Figure 27A:
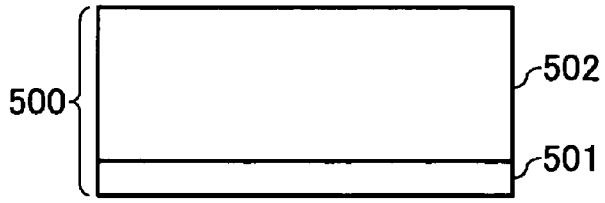
FIGS. 27A to 27D are schematic views illustrating a layer structure of an amorphous silicon photoconductor.
Figure 27B:
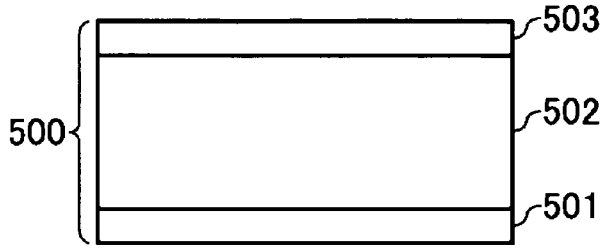
Figure 27C:
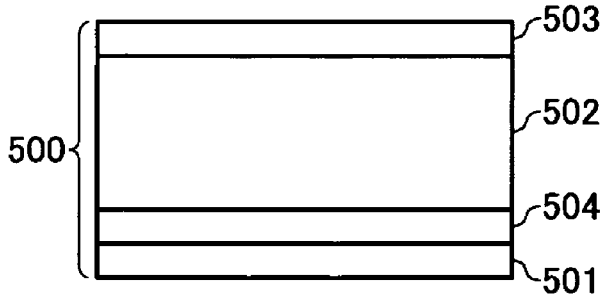
Figure 27D:
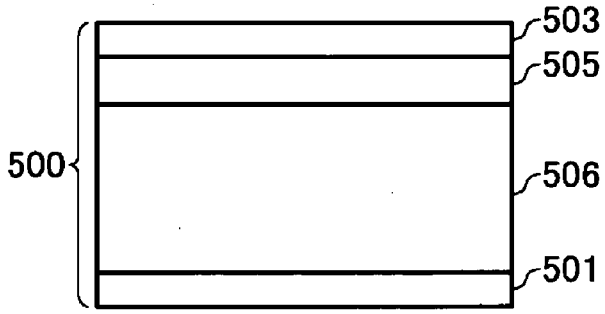

FIGS. 27A to 27D are schematic views illustrating a layer structure of the a-Si photoconductor. Referring to FIG. 27A, an a-Si photoconductor 500 includes a conductive support 501 and a photoconductive layer 502. The photoconductive layer 502 having a photoconductive property is formed on the conductive support 501, and includes an amorphous material including a silicon atom (Si), a hydrogen atom (H), and a halogen atom (X) (hereinafter referred to as an "a-Si:H,X"). Referring to FIG. 27B, the a-Si photoconductor 500 includes the conductive support 501, the photoconductive layer 502 formed on the conductive support 501, and an a-Si surface layer 503 formed on the photoconductive layer 502. Referring to FIG. 27C, the a-Si photoconductor 500 includes the conductive support 501, the photoconductive layer 502 having a photoconductive property, the a-Si surface layer 503, and an a-Si charge injection block layer 504. The a-Si charge injection block layer 504 is sandwiched between the conductive support 501 and the photoconductive layer 502, and the a-Si surface layer 503 is formed on the photoconductive layer 502. Referring to FIG. 27D, the a-Si photoconductor 500 includes, from bottom to top, the conductive support 501, a charge transport layer 506, a charge generating layer 505, and the a-Si surface layer 503. The charge transport layer 506 and the charge generating layer 505 include an a-Si:H,X, and a combination of the charge transport layer 506 and the charge generating layer 505 serves as the photoconductive layer 502.

Specific examples of the conductive materials used for the conductive support 501 include a metal such as Al, Cr, Mo, Au, In, Nb, Te, V, Ti, Pt, Pd, and Fe, and an alloy of the above-described metals such as a stainless steel. In addition, electric insulating supports such as a film or sheet of synthetic resins (e.g., polyester, polyethylene, polycarbonate, cellulose acetate, polypropylene, polyvinyl chloride, polystyrene, polyamide), a glass, a ceramic, and so forth, in which at least a surface thereof having a photoconductive layer is treated to have a conductive property, may be used as the conductive support 501.

The conductive support 501 may have a cylindrical shape, a plate shape, or a seamless-belt-like shape with a flat or uneven surface. A thickness of the conductive support 501 can be appropriately set based on a desired structure of the a-Si photoconductor 500. In a case in which flexibility is required for the a-Si photoconductor 500, the conductive support 501 may be formed as thin as possible, as long as the conductive support 501 reliably performs its function. However, the conductive support 501 may have a thickness of 10 μm or more, in consideration of manufacturing and handling processes and/or mechanical strength.

It may be more effective to form the a-Si charge injection block layer 504 between the conductive support 501 and the photoconductive layer 502 for preventing the charge injection from the conductive support 501 as shown in FIG. 27C. For example, the a-Si charge injection block layer 504 has a polarity dependence so as to reduce or prevent the charge injection from the conductive support 501 into the photoconductive layer 502 when the charge with a certain polarity is applied to a free surface of the a-Si surface layer 503. On the other hand, the a-Si charge injection block layer 504 does not prevent the charge injection when the charge with an opposite polarity is applied to the free surface of the surface layer 503. Therefore, the a-Si charge injection block layer 504 includes a relatively large number of atoms for controlling a conductive property thereof as compared with the photoconductive layer 502.

In order to achieve desired electrophotographic performance and economic performance, a thickness of the a-Si charge injection block layer 504 is may be from 0.1 to 5 μm, from 0.3 to 4 μm, or from 0.5 to 3 μm.

The photoconductive layer 502 may be formed on an undercoat layer as needed, and a thickness of the photoconductive layer 502 may be appropriately set in consideration of achieving desired electrophotographic performance and economic performance. The thickness of the photoconductive layer 502 may be from 1 to 100 μm, from 20 to 50 μm, or from 23 to 45 μm.

The charge transport layer 506 mainly has a function of transporting a charge, which is a part of the function performed by the photoconductive layer 502. The charge transport layer 506 includes at least a silicon atom, a carbon atom, and a fluorine atom, and may further include a hydrogen atom and an oxygen atom. According to example embodiments, the charge transport layer 506 may include an oxygen atom. The charge transport layer 506 has a desired photoconductive property, and particularly has a charge retention property, a charge generation property, and/or a charge transport property. A thickness of the charge transport layer 506 may be appropriately set in consideration of achieving desired electrophotographic performance and economic performance. The thickness of the charge transport layer 506 may be from 5 to 50 μm, from 10 to 40 μm, or from 20 to 30 μm.

The charge generating layer 505 mainly has a function of generating a charge, which is a part of the function performed by the photoconductive layer 502. The charge generating layer 505 includes at least a silicon atom, but does not include a carbon atom, and may further include an amorphous material including a silicon atom, and a hydrogen atom, as needed. The charge generating layer 505 has a desired photoconductive property, and particularly has a charge generation property and a charge transport property. A thickness of the charge generating layer 505 may be appropriately set in consideration of achieving desired electrophotographic performance and economic performance. The thickness of the charge generating layer 505 may be from 0.5 to 15 μm, from 1 to 10 μm, or from 1 to 5 μm.

The a-Si photoconductor 500 may further include the a-Si surface layer 503 on the photoconductive layer 502 formed on the conductive support 501 as needed. The a-Si surface layer 503 includes a free surface, and may provide moisture resistance, tolerance for repeated use, electric pressure resistance, environmental capability, and/or durability. A thickness of the a-Si surface layer 503 may be from 0.01 to 3 μm, from 0.05 to 2 μm, or from 0.1 to 1 μm. The a-Si surface layer 503 with a thickness less than 0.01 μm may be lost due to a friction or the like which occurs while the a-Si photoconductor 500 is rotated. On the other hand, the a-Si surface layer 503 with a thickness greater than 3 μm may cause a deterioration in electrophotographic performance due to an increase in a residual potential.

The a-Si photoconductor 500 has high surface hardness, and provides high sensitivity for long wavelength light such as a semiconductor laser beam at from 770 to 800 nm. Furthermore, deterioration due to the repeated use is hardly observed. Thus, the a-Si photoconductor 500 may be used as a photoconductor for forming electrophotographic images employed in a high-speed copying machine, a laser beam printer, and so forth.

For the purpose of improving abrasive resistance, a filler may be added to the photoconductor 1 according to example embodiments. A protective layer is provided in the outermost surface of the photoconductor 1, and a filler is added to the protective layer. Specific examples of organic fillers include fluorocarbon resin powder such as polytetrafluoroethylene, silicone resin powder, a-carbon powder, and so forth. Specific examples of inorganic fillers include metal powders such as copper, tin, aluminum, and indium, metal oxide powders such as tin oxide, zinc oxide, titanium oxide, indium oxide, antimony oxide, bismuth oxide, antimony doped tin oxide, and tin doped indium oxide, and an inorganic material such as potassium titanate. The examples of the filler described above may be used either alone or in combination, and may be dispersed in a coating liquid for the protective layer with a suitable dispersing machine. An average particle diameter of the filler may be 0.5 μm or less, or 0.2 μm or less in consideration of penetration efficiency through the protective layer. According to example embodiments, a plasticizer or a leveling agent may be added to the protective layer.

The photoconductor 1 according to example embodiments may include an organic photoconductor including a surface layer reinforced with a filler, or a cross-linked charge transport material. Thereby, the photoconductor 1 may provide improved abrasive resistance.

The surface layer of the photoconductor 1 may include either a polymer or a copolymer of a compound including vinyl fluoride, vinylidene fluoride, chlorotrifluoroethylene, tetrafluoroethylene, hexafluoropropylene, or perfluoroalkyl vinyl ether.

A conductive support may have a cylindrical or film shape formed of a metal such as aluminum and a stainless steel, paper, a plastic, and so forth. An undercoat layer having protection and adhesive performance may be provided on the conductive support. The undercoat layer is provided for improving adhesive and coating performance of the photoconductive layer, protecting the conductive support, covering a defect on the conductive support, improving the charge injection from the conductive support, and/or protecting the photoconductive layer from electric coating. Specific examples of a material included in the undercoat layer include polyvinyl alcohol, poly-N-vinyl imidazole, polyethylene oxide, ethyl cellulose, methyl cellulose, an ethylene-acrylic acid copolymer, casein, polyamide, a nylon copolymer, a glue, a gelatine, and so forth. Each of the above-described example materials is dissolved in a solvent suitable therefor, and is applied to the conductive support in a thickness of from 0.2 to 2 μm.

The photoconductive layer may have a laminated structure including the charge generating layer including a charge generating material, and the charge transport layer including a charge transport material, a single-layer structure including the charge generating material and the charge transport material, and so forth.

Specific examples of the charge generating material include a pyrylium dye, a thiopyrylium dye, a phthalocyanine pigment, an anthanthrone pigment, a dibenzopyrenequinone pigment, a pyranthrone pigment, a trisazo pigment, a disazo pigment, an azo pigment, an indigo pigment, a quinacridone pigment, unsymmetrical quinocyanine, quinocyanine, and so forth.

A cross-linked charge transport material may be used as the charge transport material. Specific examples of the charge transport material include a triarylmethane compound such as pyrene, N-ethylcarbazole, N-isopropyl carbazole, N-methyl-N-phenylhydrazino-3-methylidene-9-ethylcarbazole, N,N-diphenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine, p-diethylaminobenzaldehyde-N,N-diphenylhydrazone, and p-diethylaminobenzaldehyde-(2-methylphenyl) phenylmethane, a polyarylalkane compound such as 1,1-bis (4-N,N-dimethylamino-2-methylphenyl)heptane and 1,1,2, 2-tetrakis(4-N,N-dimethylamino-2-methylphenyl)ethane, and a triarylamine compound.

A toner particle that may be used in the image forming apparatus according to example embodiments is described in detail below. In example embodiments, a toner particle having a high circularity with a shape factor SF-1 of from 100 to 150 is used. When a shape of the toner particle becomes close to a sphere, toner particles contact each other as well as the photoconductor 1 in a point contact manner. Consequently, absorbability between the toner particles decreases, resulting in an increase in fluidity. Moreover, absorbability between the toner particles and the photoconductor 1 decreases, resulting in an increase in a transfer rate. The use of a toner particle with a shape factor SF-1 of more than 150 is not preferable due to a decrease in the transfer rate.

Figure 28:
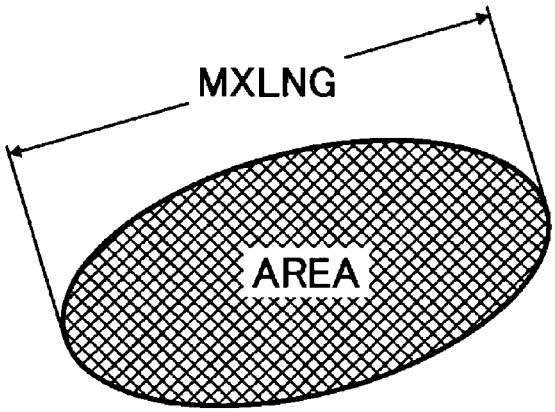
FIG. 28 is a schematic view illustrating a shape of a toner particle for explaining a shape factor SF-1.

FIG. 28 is a schematic view illustrating a shape of a toner particle for explaining the shape factor SF-1. The shape factor SF-1 indicates a proportional roundness of the toner particle, and is expressed by an equation of the form SF-1={(MXLNG)$^2$/AREA}×(100π/4). The shape factor SF-1 is obtained by dividing the square of the maximum length MXLNG of the shape produced by projecting the toner particle in a two-dimensional plane, by the figural surface area AREA, and subsequently multiplying by 100π/4.

Figure 29:
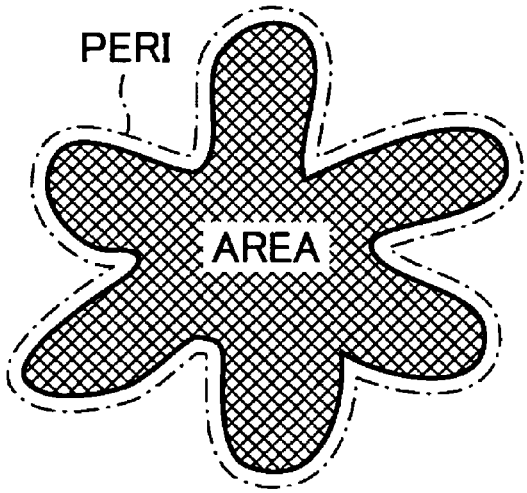
FIG. 29 is a schematic view illustrating a shape of a toner particle for explaining a shape factor SF-2.

FIG. 29 is a schematic view illustrating a shape of a toner particle for explaining a shape factor SF-2. The shape factor SF-2 indicates a proportional bumpiness of the toner shape, and is expressed by an equation of the form SF-2={(PELI)$^2$/AREA}×(100/4π). The shape factor SF-2 is obtained by dividing the square of the perimeter PER1 of the figure produced by projecting the toner particle in a two-dimensional plane, by the figural surface area AREA, and subsequently multiplying by 100/4π.

In specific terms, the shape factors SF-1 and SF-2 are measured by photographing randomly selected 100 toner particles with scanning electron microscope S-800 manufactured by Hitachi Ltd., putting photographic data of the toner particles in image analyzer Lusex 3 manufactured by Nireko Corporation via an interface to analyze the photographic data, and making calculations from analyzed data.

Figure 30:
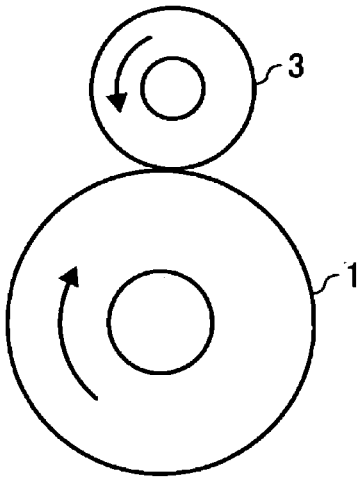
FIG. 30 is a schematic view illustrating a configuration in which a charging roller is provided in contact with the photoconductor.
Figure 31:
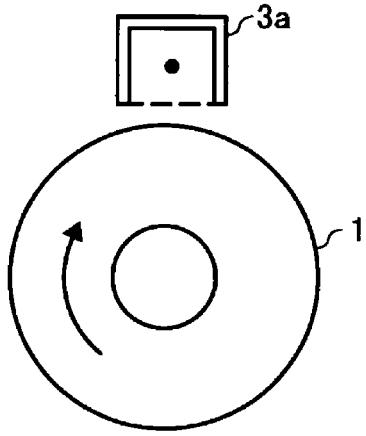
FIG. 31 is a schematic view illustrating a configuration in which a corona charger is provided as a charging device.
Figure 32:
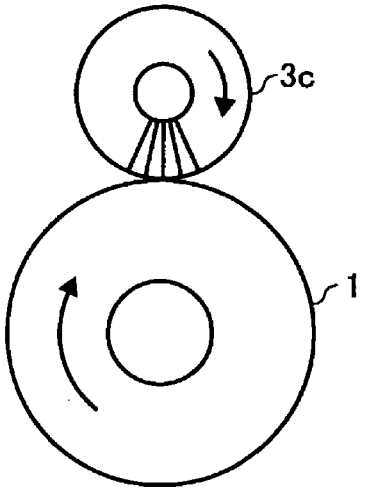
FIG. 32 is a schematic view illustrating a configuration in which a magnetic brush roller is provided as the charging device.
Figure 33:
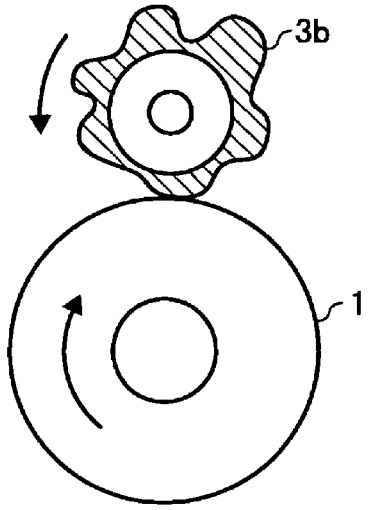
FIG. 33 is a schematic view illustrating a configuration in which a fur brush is provided as the charging device.

As described above, in the printer 100, the charging roller 3 to charge the surface of the photoconductor 1 is provided apart from the photoconductor 1 with a predetermined or desired distance. Alternatively, the charging roller 3 may be provided in contact with the photoconductor 1 as shown in FIG. 30. In place of the charging roller 3, the surface of the photoconductor 1 may be charged by a corona charger 3*a* shown in FIG. 31, a fur brush 3*c* shown in FIG. 32, and a magnetic brush 3*b* shown in FIG. 33.

Figure 34:
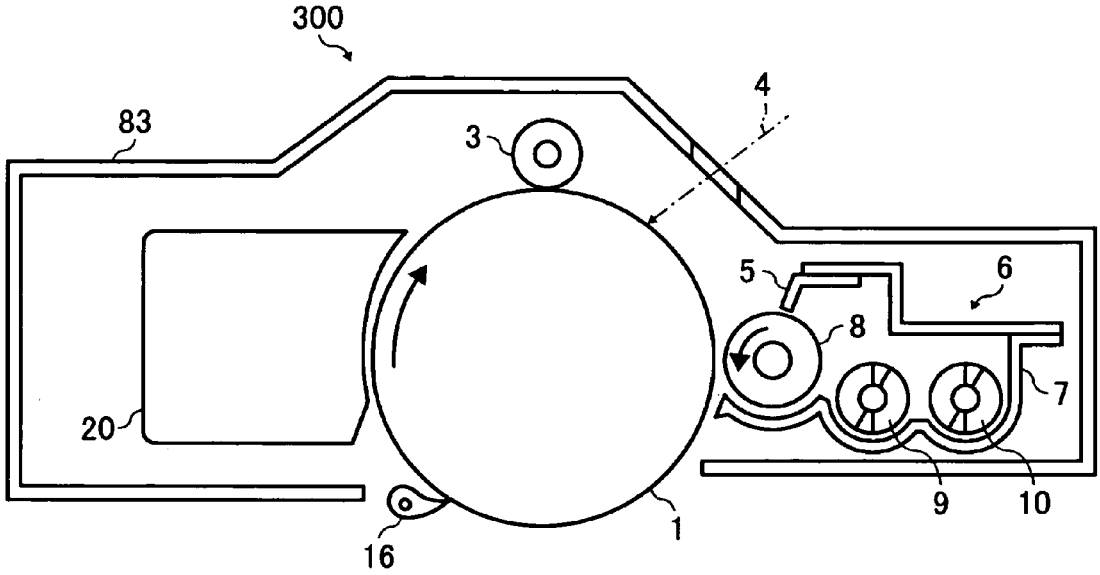
FIG. 34 is a schematic view illustrating an embodiment of a process cartridge according to example embodiments.

As shown in FIG. 34, the photoconductor 1 and the cleaning device 20 may be integrally formed within a frame 83 to form a process cartridge 300 which can be attached to/detached from the printer 100. Although not only the photoconductor 1 and the cleaning device 20, but also the charging roller 3 and the developing device 6 are integrally provided in the process cartridge 300 shown in FIG. 34, the process cartridge 300 in which at least the photoconductor 1 and the cleaning device 20 are integrally provided is applicable.

Examples of employing the cleaning device 20 according to example embodiments in a color printer are described in detail below with reference to FIGS. 35 and 36.

Figure 35:
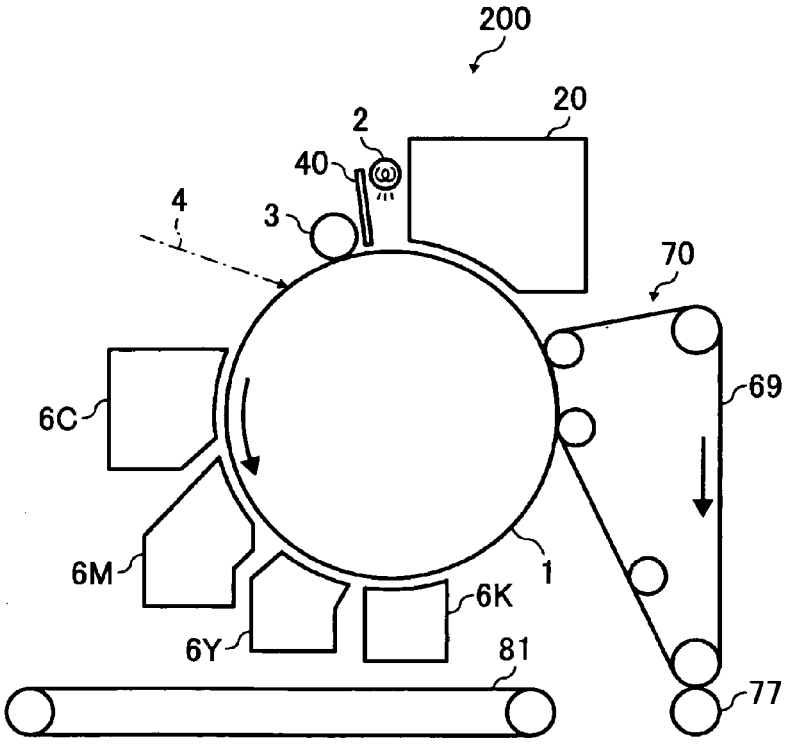
FIG. 35 is a schematic view illustrating a single-drum type full-color image forming apparatus according to example embodiments.

FIG. 35 is a schematic view illustrating a single-drum type full-color image forming apparatus 200 in which the cleaning device 20 according to example embodiments is employed. In the single-drum type full-color image forming apparatus 200, the photoconductor 1 is provided within a casing, not shown. The charging roller 3, developing devices 6C, 6M, 6Y, and 6K corresponding to toner colors of cyan (C), magenta (M), yellow (Y), and black (K), respectively, an intermediate transfer device 70, the cleaning device 20, and so forth, are provided around the photoconductor 1. The single-drum type full-color image forming apparatus 200 further includes a paper feed cassette, not shown, in which a plurality of transfer sheets P is stored. A paper feed roller, not shown, feeds the transfer sheet P sheet by sheet from the paper feed cassette, and the transfer sheet P is conveyed to a secondary transfer area between a secondary transfer device 77 and the intermediate transfer device 70 at a timing controlled by a pair of registration rollers, not shown.

When image forming processes are started in the single-drum type full-color image forming apparatus 200, the photoconductor 1 is rotated in a counterclockwise direction, and an intermediate transfer belt 69 is driven in a clockwise direction in FIG. 35. After the charging roller 3 has evenly charged the surface of the photoconductor 1, the laser beam 4 modulated with cyan image data is irradiated to the surface of the photoconductor 1 to form an electrostatic latent image of cyan on the surface of the photoconductor 1. Subsequently, the developing device 6C develops the electrostatic latent image of cyan with a cyan toner. An obtained cyan toner image is primarily transferred onto the intermediate transfer belt 69. After the cleaning device 20 has removed residual cyan toner particles from the surface of the photoconductor 1, the charge roller 3 evenly charges the surface of the photoconductor 1 again. Next, the laser beam 4 modulated with magenta image data is irradiated to the surface of the photoconductor 1 to form an electrostatic latent image of magenta on the surface of the photoconductor 1. Subsequently, the developing device 6M develops the electrostatic latent image of magenta with a magenta toner. An obtained magenta toner image is primarily transferred onto the intermediate transfer belt 69 such that the magenta toner image is superimposed on the cyan toner image primarily transferred onto the intermediate transfer belt 69 in advance. Thereafter, yellow and black toner images are primarily transferred onto the intermediate transfer belt 69, respectively, by the similar processes described above. The toner images of each color, which are superimposed on one another on the intermediate transfer belt 69, are transferred by the secondary transfer device 77 onto the transfer sheet P conveyed to the secondary transfer area. The transfer sheet P having a transferred toner image thereon is conveyed to a fixing device, not shown, by a sheet conveyance belt 81. In the fixing device, heat and pressure are applied to the transfer sheet P to fix the toner image onto the transfer sheet P. After fixing has been performed, the transfer sheet P is discharged to a discharge tray, not shown. The residual toner particles on the surface of the photoconductor 1 after transfer has been performed are removed by the cleaning device 20. The residual toner particles on the surface of the intermediate transfer belt 69 are removed by an intermediate transfer belt cleaning device, not shown.

Even if toner particles having a spherical shape are used in the single-drum type full-color image forming apparatus 200 shown in FIG. 35, the residual toner particles may be removed from the surface of the photoconductor 1 by using the cleaning device 20. Moreover, even in a case in which most of the residual toner particles may have the positive polarity or the negative polarity depending on environmental changes, the cleaning device 20 may remove the residual toner particles from the surface of the photoconductor 1.

Figure 36:
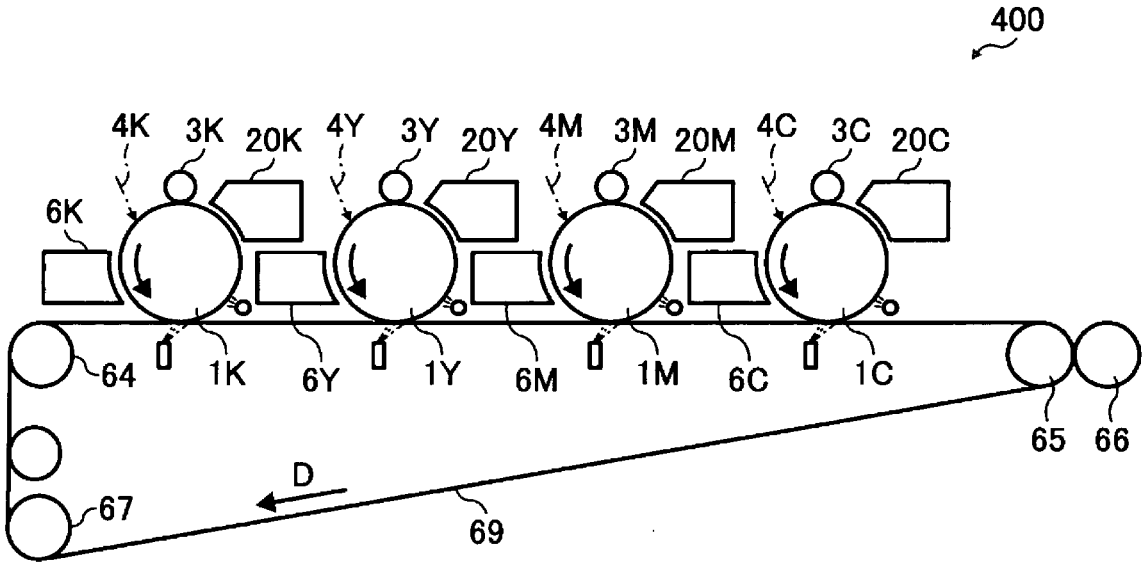
FIG. 36 is a schematic view illustrating a tandem type full-color image forming apparatus according to example embodiments.

FIG. 36 is a schematic view illustrating a tandem type full-color image forming apparatus 400 in which the cleaning device 20 according to example embodiments is employed. The tandem type full-color image forming apparatus 400 includes the intermediate transfer belt 69 tightly stretched across a plurality of rollers 64, 65, and 67, such that a horizontal length of the tandem type full-color image forming apparatus 400 is longer than a vertical length thereof when the tandem type full-color image forming apparatus 400 is installed on a horizontal surface. The intermediate transfer belt 69 is driven in a direction indicated by an arrow D in FIG. 36. Four photoconductors 1Y, 1M, 1C, and 1K (hereinafter collectively referred to as the "photoconductor 1") are aligned on a horizontally stretched portion of the intermediate transfer belt 69. Charging rollers 3Y, 3M, 3C, and 3K (hereinafter collectively referred to as the "charging roller 3"), the developing devices 6Y, 6M, 6C, and 6K (hereinafter collectively referred to as the "developing device 6"), cleaning devices 20Y, 20M, 20C, and 20K (hereinafter collectively referred to as the "cleaning device 20"), and so forth, are provided around the photoconductor 1, respectively. The tandem type full-color image forming apparatus 400 further includes a paper feed cassette, not shown, in which a plurality of transfer sheets P is stored. A paper feed roller, not shown, feeds the transfer sheet P sheet by sheet from the paper feed cassette, and the transfer sheet P is conveyed to a secondary transfer area between a secondary transfer roller 66 and the intermediate transfer belt 69 at a timing controlled by a pair of registration rollers, not shown.

When image forming processes are started in the tandem type full-color image forming apparatus 400, the photoconductor 1 is rotated in a counterclockwise direction, and the intermediate transfer belt 69 is driven in the direction indicated by the arrow D in FIG. 36. After the charging roller 3 has evenly charged the surface of the photoconductor 1, laser beams 4Y, 4M, 4C, and 4K (hereinafter collectively referred to as the "laser beam 4"), which are modulated with image data of each color, are irradiated to the surface of the photoconductor 1 to form electrostatic latent images of yellow, magenta, cyan, and black, on the surface of the photoconductor 1, respectively. Subsequently, the developing device 6 develops the electrostatic latent images of each color with toners of corresponding colors to form toner images of each color. Obtained toner images of each color are primarily transferred onto the intermediate transfer belt 69 such that the toner images are superimposed on one another. The superimposed toner images are transferred by the secondary transfer roller 66 onto the transfer sheet P conveyed to the secondary transfer area. The transfer sheet P having a transferred toner image thereon is conveyed to a fixing device, not shown. In the fixing device, heat and pressure are applied to the transfer sheet P to fix the toner image onto the transfer sheet P. After fixing has been performed, the transfer sheet P is discharged to a discharge tray, not shown. The residual toner particles on the surface of the photoconductor 1 after transfer has been performed are removed by the cleaning device 20. The residual toner particles on the surface of the intermediate transfer belt 69 are removed by an intermediate transfer belt cleaning device, not shown.

Even if toner particles having a spherical shape are used in the tandem type full-color image forming apparatus 400 shown in FIG. 36, the residual toner particles can be removed from the surfaces of the photoconductor 1 by using the cleaning device 20. Moreover, when most of the residual toner particles may have the positive polarity or the negative polarity depending on environmental changes, the cleaning device 20 may remove the residual toner particles from the surface of the photoconductor 1.

According to example embodiments, the cleaning device neutralizing lamp 25 is provided at a downstream side of the conductive blade 22 to which the negative polarity is applied so that the surface of the photoconductor 1 negatively charged by the conductive blade 22 can be neutralized. As a result, a potential gradient between the surface of the photoconductor 1 and the cleaning brush 23 having the positive polarity decreases. When the potential gradient between the surface of the photoconductor 1 and the cleaning brush 23 is smaller, only a smaller amount of current flows through the residual toner particles between the surface of the photoconductor 1 and the cleaning brush 23 in order to compensate the potential gradient, suppressing the positive charge injection into the residual toner particles. Therefore, the polarity of the residual toner particles is hardly reversed, and is kept unchanged. As a result, the residual toner particles on the surface of the photoconductor 1 can be electrostatically removed by the cleaning brush 23.

In the related-art cleaning device for mechanically removing the residual toner particles on the surface of the photoconductor by using a blade, a fur brush, or the like, a neutralizing device such as a pre-cleaning charger and a pre-cleaning lamp is provided at an upstream side of the cleaning device for reducing an electrostatic attraction between the photoconductor and the residual toner particles to improve cleaning performance. Unlike the above-described related-art cleaning device, the cleaning device 20 according to example embodiments includes the cleaning device neutralizing lamp 25 for controlling the charge injection into the residual toner particles so that the residual toner particles can be electrostatically removed from the surface of the photoconductor 1 by using the cleaning brush 23.

According to example embodiments, a voltage having a polarity similar to that of the photoconductor 1 is applied to the conductive blade 22. In such a case, the photoconductor 1 is likely to have a higher potential due to the charge injection from the conductive blade 22. To solve such a problem, the cleaning device neutralizing lamp 25 included in the cleaning device 20 neutralizes the surface of the photoconductor 1 to reduce a potential gradient between the photoconductor 1 and the cleaning brush 23. As a result, improved cleaning performance may be obtained.

Although the toner particles having a spherical shape are used in the developing device 6 to obtain higher quality images, such toner particles may be removed from the surface of the photoconductor 1 by using the cleaning device 20.

In example embodiments, toner particles having a high circularity with a shape factor SF-1 of from 100 to 150 are used. When a shape of the toner particles becomes close to a sphere, the toner particles contact each other as well as the photoconductor 1 in a point contact manner. Consequently, absorbability between the toner particles decreases, resulting in an increase in fluidity. Moreover, absorbability between the toner particles and the photoconductor 1 decreases, resulting in an increase in a transfer rate. As a result, higher quality images can be obtained.

The cleaning device 20 includes the conductive blade 22 for controlling the polarity of the residual toner particles. Because the conductive blade 22 preliminary removes the residual toner particles in a simple way prior to electrostatic cleaning performed by the cleaning brush 23, it may be beneficial to employ the conductive blade 22 in example embodiments.

The cleaning device neutralizing lamp 25 may neutralize the surface of the photoconductor 1 without affecting the potential of the residual toner particles controlled by the conductive blade 22.

In the single-drum type full-color image forming apparatus 200, the residual toner particles on the surface of the photoconductor 1 may be removed by using the cleaning device 20. Because the residual toner particles may be removed from the surface of the photoconductor 1, the residual toner particles do not enter the developing device 6 of the other colors, preventing color mixture. Consequently, higher quality images may be obtained.

In the tandem type full-color image forming apparatus 400, the cleaning device 20 can remove the residual toner particles from the surface of the photoconductor 1. Consequently, higher quality images can be obtained.

The photoconductor 1 according to example embodiments includes a material into which a filler is dispersed, resulting in an improvement in abrasive resistance.

The photoconductor 1 according to example embodiments includes an organic photoconductor including a surface layer reinforced with a filler, an organic photoconductor including a cross-linked charge transport material, or an organic photoconductor with the characteristics of the above-described two organic photoconductors. Thereby, the photoconductor 1 may provide an improvement in abrasive resistance.

The photoconductor 1 according to example embodiments includes an a-Si photoconductor, preventing abrasion. Consequently, exfoliation or peeling of the photoconductive layer in the photoconductor 1 may be suppressed, and the surface of the photoconductor 1 may be kept flat.

At least the photoconductor 1 and the cleaning device 20 are integrally provided in the process cartridge 300, so that the photoconductor 1 and the cleaning device 20 may be easily attached to/detached from the printer 100. As a result, the process cartridge 300 may be effectively replaced with a new one.

Example embodiments are not limited to the details described above, but various modifications and improvements are possible without departing from the spirit and scope of example embodiments. It is therefore to be understood that within the scope of the associated claims, example embodiments may be practiced otherwise than as specifically described herein. For example, elements and/or features of different illustrative example embodiments may be combined with each other and/or substituted for each other within the scope of example embodiments.

What is claimed is:

1. A cleaning device to remove residual toner particles on an image bearing member, comprising:

a polarity control unit to control a charge polarity of residual toner particles;

a cleaning member, a surface of which is movable, to electrostatically remove the residual toner particles, provided on a downstream side from the polarity control unit relative to a surface moving direction of the image bearing member;

a toner collecting unit to collect the residual toner particles on the cleaning member; and a neutralizing member to neutralize the image bearing member, provided on a downstream side from the polarity control unit and an upstream side from the cleaning member relative to the surface moving direction of the image bearing member, wherein the polarity control unit includes a conductive elastic blade, the conductive elastic blade contacts the image bearing member against the direction of rotation of the image bearing member, and the neutralizing member is provided within a space formed by the conductive elastic blade between the conductive elastic blade and the cleaning member.

2. The cleaning device according to claim 1, wherein a voltage with a polarity same as a polarity of the image bearing member is applied to the polarity control unit.

3. The cleaning device according to claim 1, wherein the residual toner particles have a spherical shape.

4. The cleaning device according to claim 3, wherein the residual toner particles have a shape factor SF-1 of from 100 to 150.

5. The cleaning device according to claim 1, wherein the neutralizing member comprises a neutralizing lamp.

6. A process cartridge detachably attachable to an image forming apparatus, comprising:

the image bearing member; and the cleaning device of claim 1.

7. An image forming apparatus, comprising:

at least one image bearing member to bear an electrostatic latent image;

a charging device to charge a surface of the image bearing member;

an irradiating device to irradiate the charged surface of the image bearing member to form an electrostatic latent image thereon;

at least one developing device to develop the electrostatic latent image with a toner to form a toner image;

a transfer device to transfer the toner image onto a recording medium; and the cleaning device of claim 1.

8. The image forming apparatus according to claim 7, wherein the at least one image bearing member comprises a photoconductor including a material into which a filler is dispersed.

9. The image forming apparatus according to claim 7, wherein the at least one image bearing member comprises an organic photoconductor having a surface layer reinforced with a filler.

10. The image forming apparatus according to claim 7, wherein the at least one image bearing member comprises an organic photoconductor including a cross-linked charge transport material.

11. The image forming apparatus according to claim 7, wherein the at least one image bearing member comprises an amorphous silicon photoconductor.

12. The image forming apparatus according to claim 7, wherein the at least one developing device includes a plurality of developing devices to form a plurality of toner images on the at least one image bearing member, wherein the toner images are superimposed on one another to form a full-color image.

13. The image forming apparatus according to claim 7, wherein the at least one image bearing member includes a plurality of image bearing members; and the at least one developing device includes a plurality of developing devices, each of which forms a toner image on each of the plurality of image bearing members, wherein the toner images formed on the plurality of image bearing members are superimposed on one another to form a full-color image.

* * * * *